US005364234A

United States Patent [19]

Eickmann

[11] Patent Number: 5,364,234

[45] Date of Patent: Nov. 15, 1994

[54] HIGH PRESSURE DEVICES

[76] Inventor: Karl Eickmann, 2420 Isshiki, Hayama-machi, Kanagawa-ken 24001, Japan

[21] Appl. No.: 820,831

[22] Filed: May 20, 1992

[51] Int. Cl.[5] ..... F04B 1/04; F04B 27/04

[52] U.S. Cl. ..... 417/273; 417/395; 91/491; 92/72; 92/129

[58] Field of Search ..... 417/273, 395; 74/55; 91/491, 492; 92/12.1, 72, 129, 187

[56] References Cited

U.S. PATENT DOCUMENTS

| | | | |
|---|---|---|---|
| 3,874,271 | 4/1975 | Eickmann | 91/491 |
| 4,004,498 | 1/1977 | Aoki | 91/491 |
| 4,366,747 | 1/1983 | Falendysz et al. | 417/273 |
| 4,378,201 | 3/1983 | Quarve | 417/395 |
| 4,475,870 | 10/1984 | Eickmann | 417/206 |
| 4,498,372 | 2/1985 | Pareja | 417/273 |
| 4,573,885 | 3/1986 | Petersen | 417/395 |
| 5,035,221 | 7/1991 | Martin | 417/273 |

*Primary Examiner*—Richard A. Bertsch
*Assistant Examiner*—Alfred Basichas

[57] ABSTRACT

The invention proposes a fluid handling device, which may be a pump, in which arrangements are provided to make the device able to handle high pressure of more than one thousand atmospheres and able to seal at such high pressure for a considerably long life time of the device. For the obtainment of such a performance, a piston shoe arrangement has a part-ball formed portion with an outer face which is guided on a cylindrical inner face, while the piston shoe at the same time pivots around a center which is located in the pistons-head. Sealing means are provided to faces of plates, membranes or pistons to reduce leakage or to reduce the negative effects of deformations under high pressures. In this relation a thrust body may be axially moveably provided in a thrust chamber and obtain thereby a novel and effective sealing of membranes and faces.

9 Claims, 18 Drawing Sheets

409
409
408
410
411
416
417
459
414
415
407
66
138
139
591
66
412
413
405
137
58
62
404
58
4
135
406
61
11
4
57
403
402
5
401
456
454
559
455
452
451
453
546
560
450
449
457
557
448
458
447
591
443
445
e
Pp
442
446
570
444

409
409
408
410
411
416
417
459
414
415
407
591
66
66
138
139
412
413
431
431
137
58
62
404
58
58
4
4
57
441
433
432
437
430
438
439
61
5
456
454
455
452
461
451
453
546
450
449
457
448
458
447
443
445
e
442
446
570
444

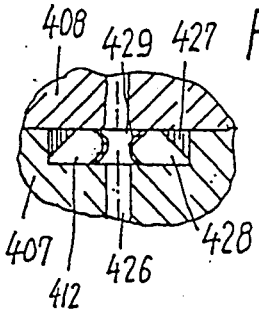
Fig. 4
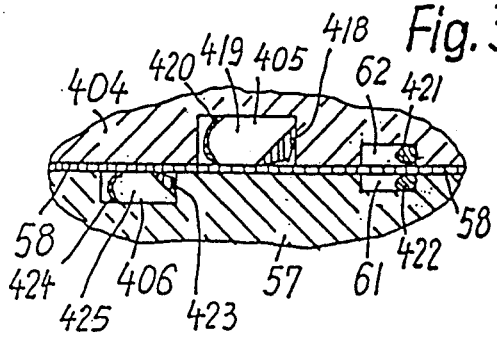
Fig. 3
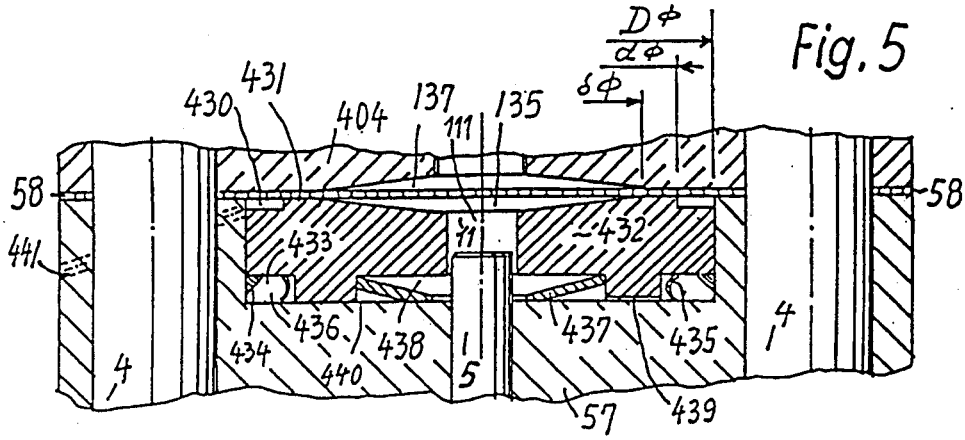
Fig. 5
Fig. 7
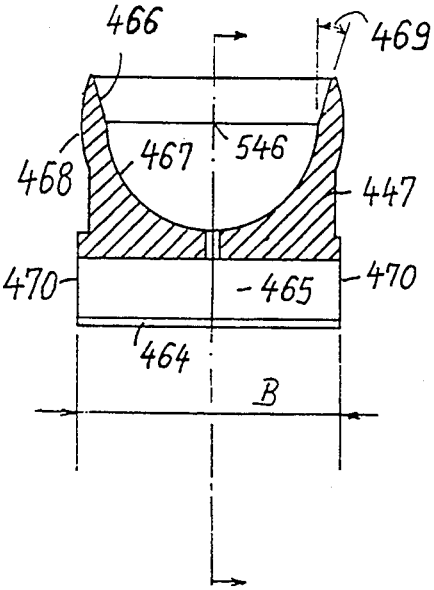
Fig. 6
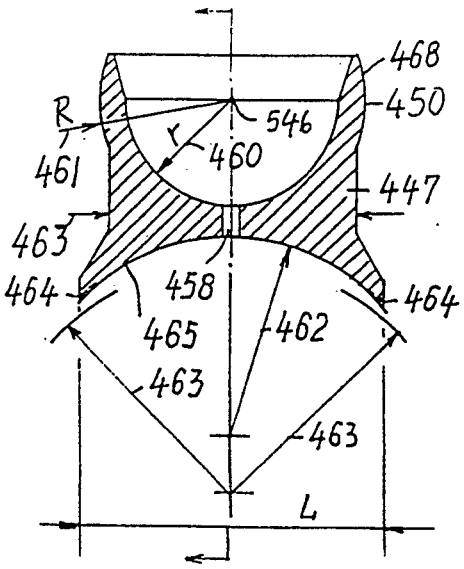

66
38
39
138
139
481
485
58
135
478
480
479
482
58
483
4
4
57
484
5
456
454
455
452
451
453
450
449
448
458
447
464
443
445
e
442
446
444

448
4
447
g
G
e
444
513
L
L = ≤ D 512
4A
L = ≤ 0,75 D
L
Q = S = 513
G = 514
a = 515
447A
511
e = 516
447G
e
4B
4C
447B
444

1,4,7
517
120°
445
120°
3,6,9
2,5,8

1
22
23
22
23
9
4
23
40°
40°
23
40°
518
22
6
7
40°
40°
40°
445
40°
2
22
3
23
8
23
5

A
40°
445
160°
160°
C
B

A
120°
120°
445
120°
B
C

Fig. 21
| α | 0 | 20 | 40 | 60 | 80 | 100 | 120 | 140 | 160 | 180 | 200 | 220 | 240 | 260 | 280 | 300 | 320 | 340 | 360 |
|---|---|---|---|---|---|---|---|---|---|---|---|---|---|---|---|---|---|---|---|
| HUBSTART IN FIG. 17 - 19 | | C9 | | A3 | | B5 | | C7 | | A1 | | B6 | | C8 | | A2 | | B4 | |
| HUBSTART IN FIG. 18-20 | | C9 | | A3 | | B5 | | C7 | | A1 | | B6 | | C8 | | A2 | | B4 | |
Fig. 22
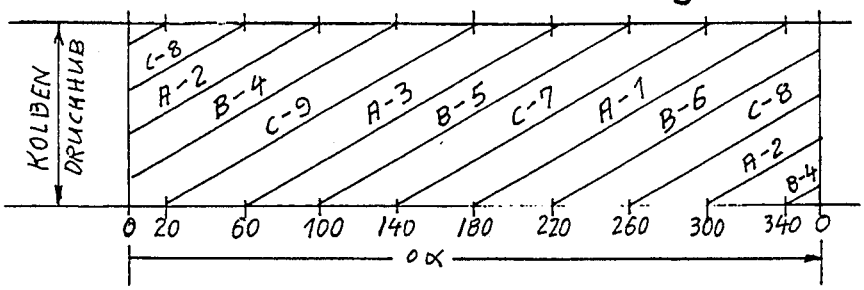
Fig. 23
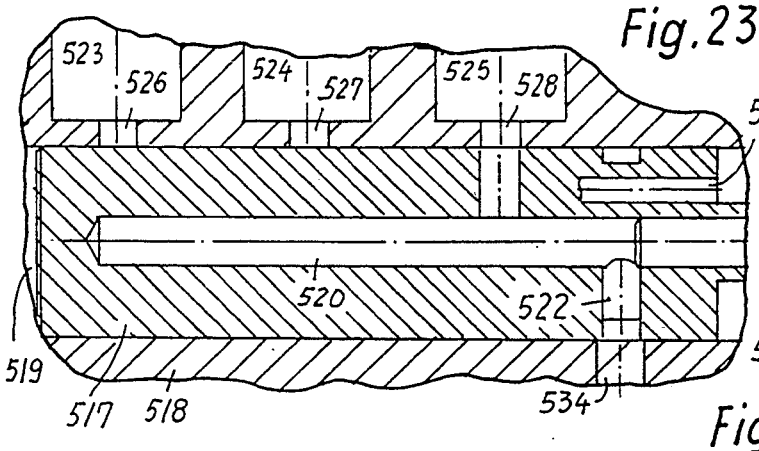
Fig. 24
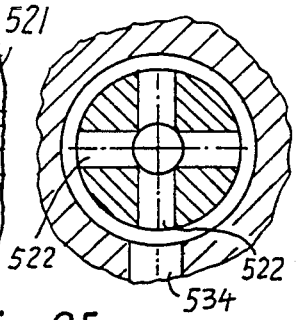
Fig. 25
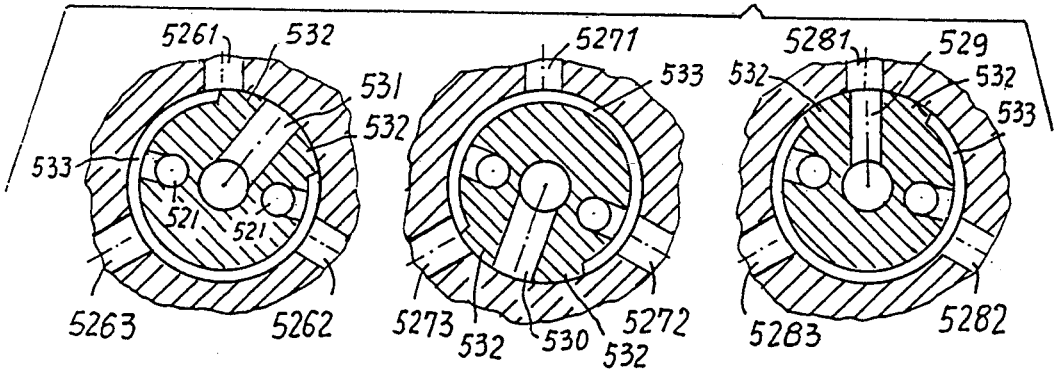

$G = R + g$ $q = g - g\cos\beta$ $\sin\beta = (e/G)\sin\alpha$ by sin rule $S$ = stroke $= e - e\cos\alpha + q - g\cos\beta$ $V$ = velocity $= -\omega[e\sin\alpha + g\sin\beta]$ $b$ = acceleration $= -\omega^2[e\cos\alpha + g\cos\beta]$

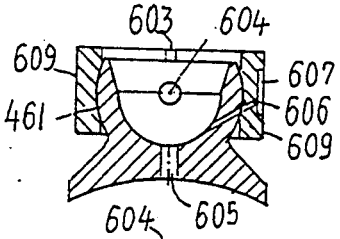
Fig. 42
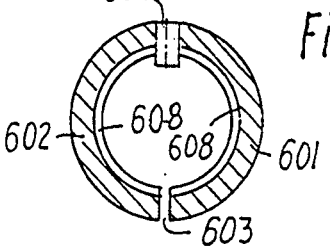
Fig. 43
Fig. 31
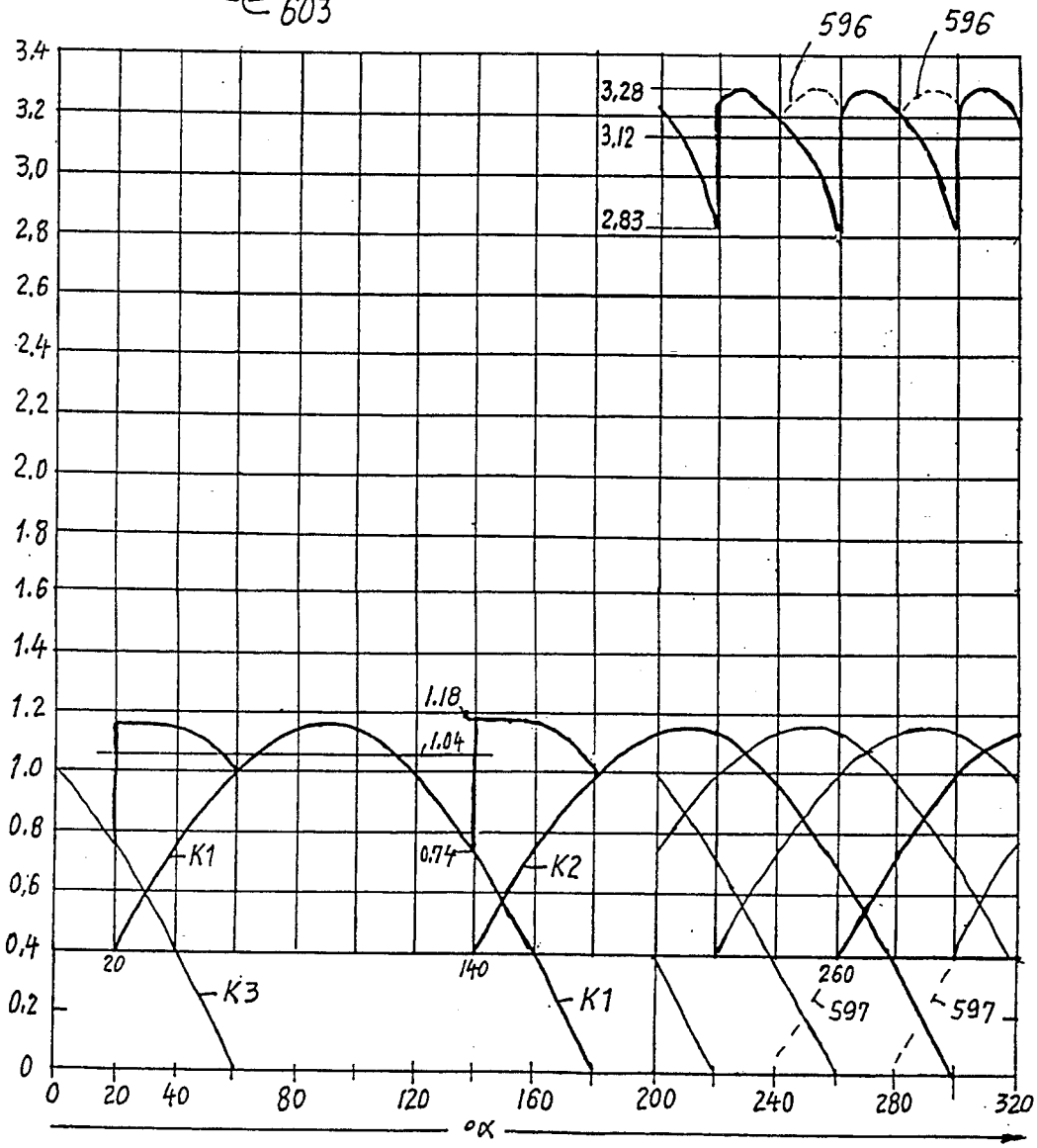

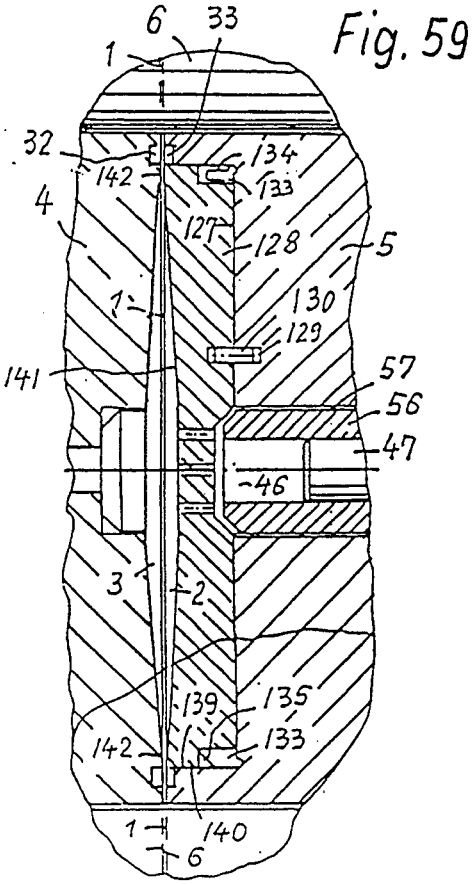
Fig. 59
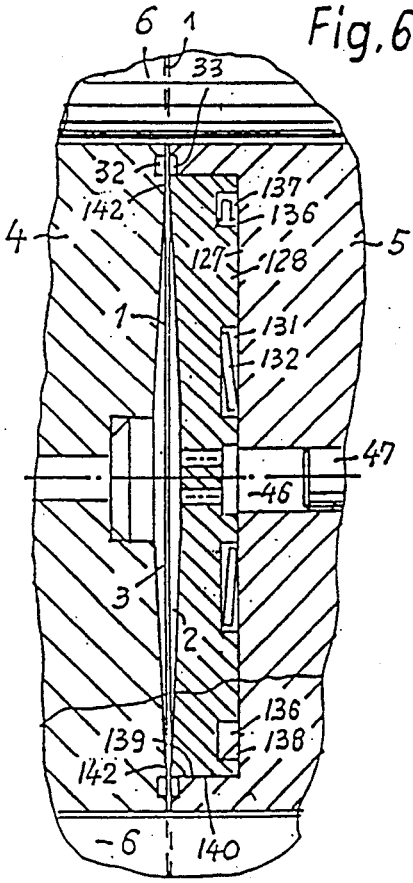
Fig. 60
Fig. 61
$$u = \frac{(m-1)(r^2 P_i - R^2 P_o)\,z}{mE\,(R^2 - r^2)} + \frac{(m+1)\,r^2 R^2 (P_i - P_o)}{mE\,(R^2 - r^2)\,z}$$
Fig. 66
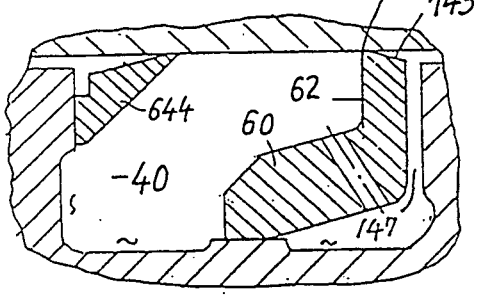

HIGH PRESSURE DEVICES

BACKGROUND OF THE INVENTION a. Field of the Invention

This invention relates to high pressure devices, for example, to fluid handling devices, such as pumps, seals or the like with a capability to handle high pressure fluids in respective chambers of the device.

b. Description of the prior art

A high pressure device, useable as pump or motor, is shown in my earlier U.S. Pat. No. 3,874,271. This Patent illustrates a device which is able to handle pressures in fluid up to about 5000 psi. It is also a device which is easy in machining and simple in design. However, at pressures in excess of five hundred atmospheres the piston shoes broke after a couple of hundred hours of work under this high pressure, or the piston shoes welded because of overload on their slide faces, while the pistons tended to weld on the walls of the cylinders under lateral components of forces, if the respective pump was in use with such high pressure for several hundred or a few thousand hours.

SUMMARY OF THE INVENTION

It is an object of the invention to overcome problems of devices of the prior art.

Another object of the invention is to increase the capability of fluid handling devices for use of pressures in excess of five thousand pounds per square inch.

A further object of the invention is, to prevent the sticking of pistons under lateral loads at high pressure.

A still further object of the invention is to overcome the welding of slide faces of piston shoes on stroke guide faces of cams at high pressure in fluid.

Still another object of the invention is to overcome the leakages in high pressure devices which appear at high pressure due to elongation of bolts, deformations of places, deformations of membranes or deformations of walls of cylinders.

To materalize one or more of the objects of the invention, certain novel and useful arrangements are provided, such, as, for example, a pivoting piston shoe which guides itself directly on a portion of a wall of a cylinder or housing, and seal means in grooves for sealing along planar faces, including preventing of outwardly or inwardly or multidirectional extrusions, or plastic seal rings; while a further arrangement is a thrust body with a self-sealing ring nose with the thrust body axially moveably located in a thrust chamber. A still further arrangement is the configuration of cylindrical cylinder walls, particularly, the provision of tapered inner faces on cylinders and bushes for sealing along pistons with the novelty that the inner diameters of the coned portions increase with distance from the entrance of the high pressure fluid.

BRIEF DESCRIPTION OF THE DRAWINGS:

FIGS. 3 to 5 are sectional views through sealing arrangements of the invention.

FIGS. 6 and 7 are sectional views through a piston shoe of the invention, wherein the views are taken along the arrowed lines of the Figures.

FIG. 21 shows a table.

FIG. 22 shows a diagram.

FIGS. 23 to 25 are sectional views through devices of the invention.

FIG. 31 also shows a diagram.

FIGS. 32 to 43 show portions of the invention in sectional views or in views onto them.

FIGS. 44 to 60 show sectional views through devices of the invention.

FIG. 61 shows an equation for evaluation of the invention, and:

FIGS. 62 to 66 show sectional views through further embodiments of the invention.

Figure 1:
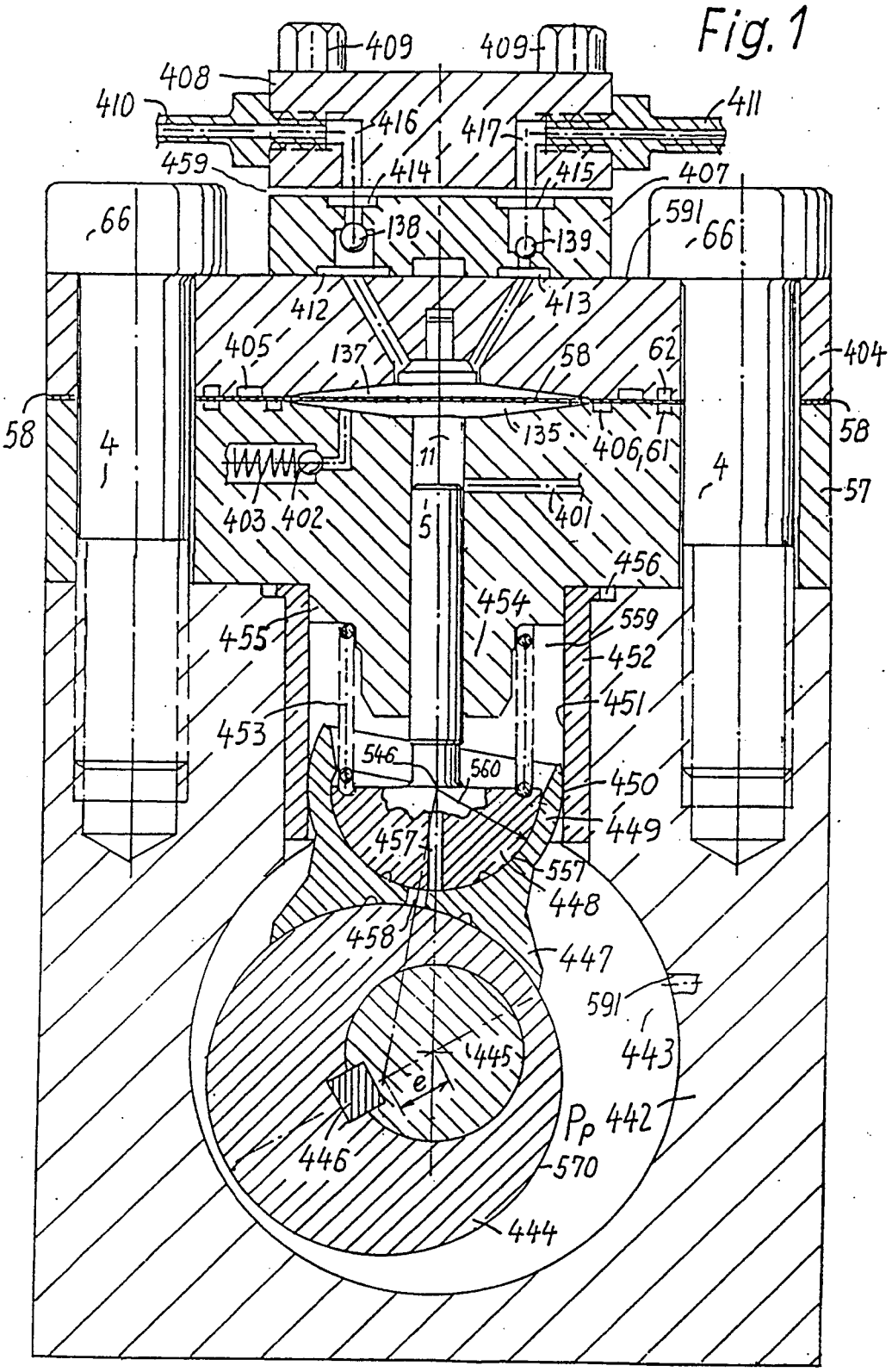
FIGS. 1, 2, 8 and 9 are sectional views through pumps of the invention.

DESCRIPTION OF THE PREFERRED EMBODIMENTS:

In FIGS. 1, 2, 8 and 9, the device of the invention is illustrated in samples of complete pumps. In the housing 442 a shaft 445 is revolvingly borne to operate an eccentric cam member 444. The at least one eccentric cam 444 has a piston stroke guide face 570, which is preferred to be a cylindrical face around an axis which is eccentric relative to the axis of the concentricly revolving shaft. Face 570 is thereby a cylindrical, but eccentric, face. Associated to the housing 442 is a cylinder block 57 which forms a cylinder 11 with a therein reciprocable piston 5. A piston shoe 447 is provided directly to the piston 5 or to an associated drive piston and the shoe 447 has a slide face 465 which is complementary configurated relative to the piston stroke guide face 570. The slide face slides along the guide face and drives the power stroke of the piston. At least one entrance means or entrance valve 138 and at least one outlet means or outlet valve 139 are provided and communicated at least indirectly to the cylinder 11. The reciprocating piston 5 provides at one half of its movements the inlet stroke, at which fluid is led into the cylinder, and at the other half of its movement a power stroke at which fluid is pressed out of the cylinder. The piston 5 or the associated drive piston has a piston-foot 448 on which the piston shoe 447 is pivotably borne.

So far the device is known in the art, for example, from my U.S. Pat. No. 4,475,870.

The devices of the so known prior art, however, have some problems, which have prevented their use at extremely high pressures and strokes. Desired by the invention are long strokes of the pistons and pressures in excess of one thousand atmospheres. Desired is further, by the present invention, to provide a piston shoe for high pressure without pressure-fluid balancing pockets between on each other sliding faces. Because if that becomes possible, the piston can become useable for non-lubricating fluids. The known devices of the prior art further had the problem that they were useable only below one thousand atmospheres or that they required fluid pressure balancing pockets. Further, lateral forces appeared on the pistons, since the pistons had to guide the piston shoes.

These problems of the prior art shall be overcome by the present invention and further novel matters will be added by this invention to the field of high pressure technology.

Figure 36:
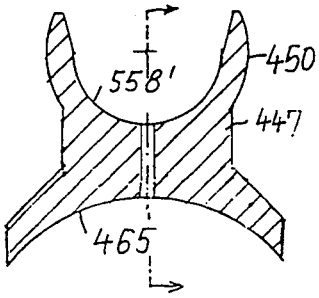
Figure 39:
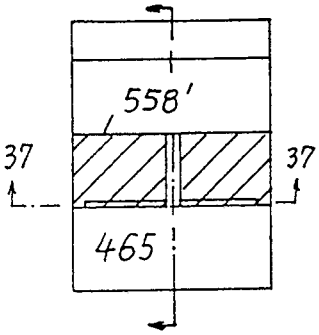

The peripherial extension of the slide face 465 of the piston shoe 447 (see FIG. 36) is, according to the present invention, so long, that it can carry the high load of more than one thousand atmospheres on the tip of the piston. The piston shoe is provided with a guide means 450 for guidance on a guide face 451. The guide face 451 is provided at least indirectly in housing 442. Guide face 451 has at least two portions which are arranged symmetric to the axis of the cylinder 11. Guide face portions 451 guide the guide means 450 of the piston shoe during the main portion of the stroke of the piston 5. Thereby an important means of the invention is obtained, namely the guiding of the piston shoe by guide face portions. This novel guiding of the piston shoe prevents lateral load on the piston and is thereby an important means to make a long high pressure stroke of a piston possible.

As seen in FIG. 6, the guide means may be a part ball formed face 468 with a "second" radius 461 around the common swing center 546 of the piston shoe. The piston foot 448 has in the preferred embodiment a part cylindrical or part-special face with a "first" radius 560 around the swing center 546, while the piston shoe forms an inner face 467 with radius 460 also around the common swing center 546. The inner face 467 of the piston shoe is now a swing face for pivoting movement along the outer face 560 of the piston foot 448. In order to obtain the desired guide effect of the invention, it is decisive that the faces 468 or 450 and 467 of the piston shoe are formed around the same, around the common, center 546, around which also the outer face 560 of the piston foot is formed. The common center 546 is then located in the axis of the piston and thereby in the axis of the reciprocating movement of the piston 5 and of the piston shoe 447. In addition to the reciprocating movement, the piston shoe 447 also is subjected to the pivotal or swinging movement around the common center 546.

Figure 13:
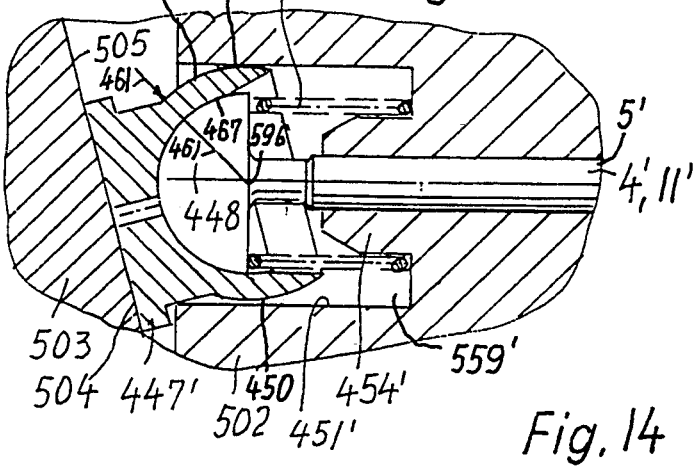
FIG. 13 is a sectional view through a portion of a device of the invention.

The so by the invention obtained secure guidance of the piston shoe prevents or reduces lateral forces on the piston and thereby makes high pressure strokes in excess of one thousand atmospheres possible. With this success of the invention securely obtained, the slide face 465 of the piston shoe for sliding on the piston stroke guide face 570 becomes respectively dimensioned and configurated to become capable of an equally high load, in accordance with the present invention. The guide face portion(s) 451=451' in FIG. 13, are formed by a third radius 461'' with this third radius rooted in the axis or its elongation of the piston 5. The third radius is at least one thousandth of a millimeter longer than the second radius to facilitate the slide and guide of face 450 on face 451.

The preferred details thereof will become apparent from the other details of the Figures.

In FIG. 1, a hardened bush 452 is inserted into the housing 442 and its inner face 451 forms the guide face portion(s) for the guidance of the piston shoe. The piston shoe 447 has a narrowed neck between its upper swing portion, which is also a "guide-portion", and its lower slide-portion, also called: "drive-portion". A spring 453 is provided in the housing or on the cylinder block to press the piston foot 448 against the piston shoe and the piston shoe against the piston stroke guide face 570 of the eccentric cam 444. Thereby the spring 453 is utilized to actuate the downward stroke or intake stroke of the piston 5 in cylinder 11.

In FIG. 1 a membrane 58 is provided to separate the lubrication fluid chamber 135 which communicates with cylinder 11, from the non-lubricating fluid chamber 137 which is communicated to the inlet and outlet valves 138 and 139. This chamber 137 may also contain a lubricating fluid, but the non-corroding membrane 58 makes the use of a not lubricating fluid in chamber 137 possible. By this way, the device of FIG. 1 can act as a water pump for pressures of more than 1000 atmospheres. At a year long actual tests, pressures were used between 200 and 3000 atmospheres. Most test were run with 2000 atmospheres in the water in chamber 137. Strong bolts 4 hold the housing 442 and the upper portions 57 and 404 of the device together.

Figure 2:
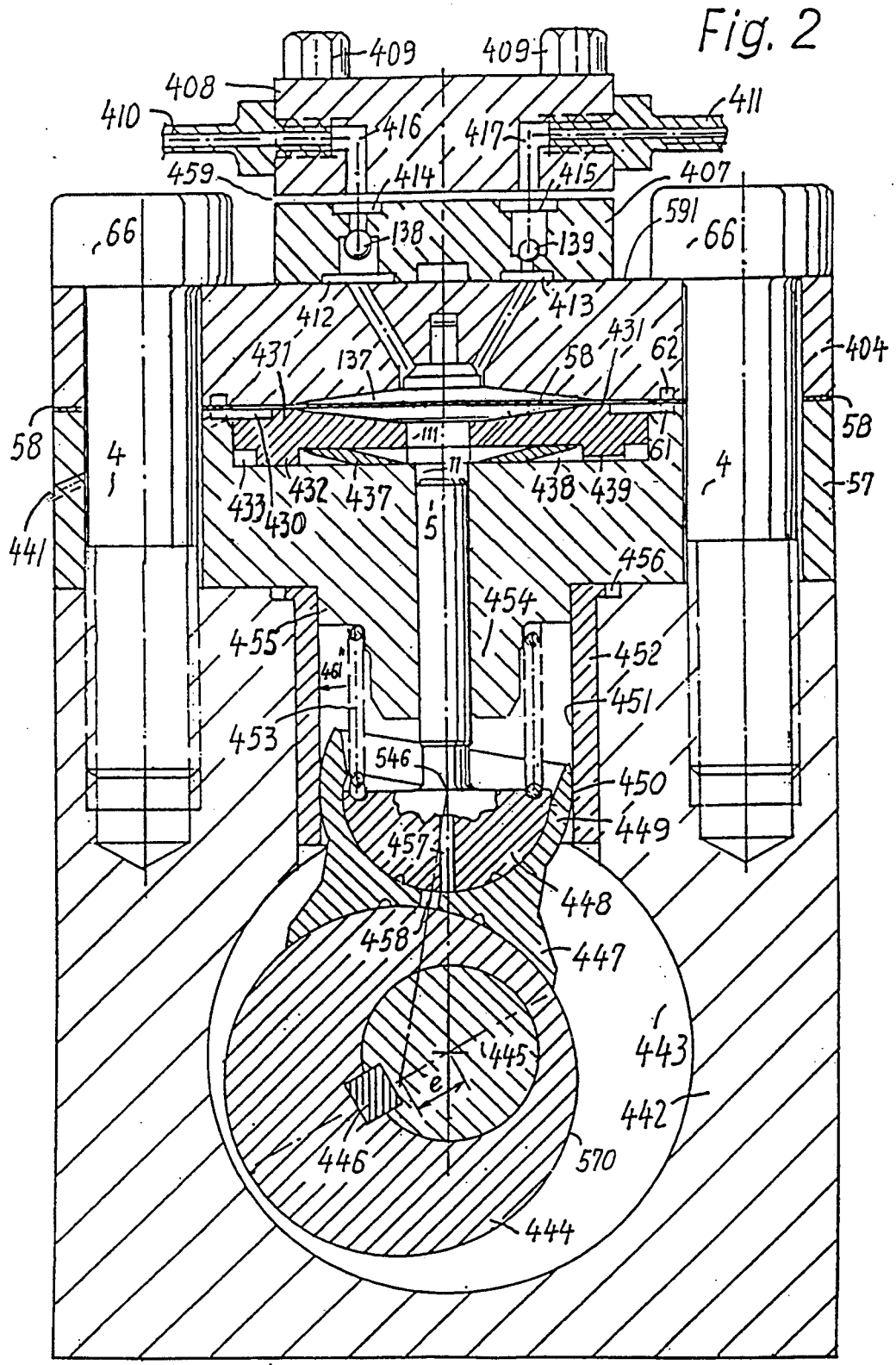

FIG. 2 contains another important feature of the invention. This is the provision of the embodiment of a thrust body 432 in a thrust chamber 438 to secure a proper sealing of the chambers 135 and 137 in radial direction. In other words, to secure a precise sealing along the membrane 58 for the high pressure in excess of one thousand atmospheres. To obtain this aim of the invention, a pressure chamber, which forms a thrust chamber, namely chamber 438, is provided in the cylinder block 57 and communicated to the cylinder 11. A thrust body 432 is assembled into the thrust chamber 438. Seal ring chambers 433 are provided to obtain seal means for sealing between the outer face of the thrust body 432 and the inner face of the wall of the thrust chamber 438. The front portion of the thrust body, which is directed towards the membrane 58, forms the chamber 137 and around it a sealing land ring nose 431. The outer diameter of the ring nose 431 is smaller than the outer diameter of the thrust body 432. Thereby an unloading recess 430 is providewd radially outwards around the ring nose 431. As a result of this arrangement the cross sectional area of the thrust chamber 438 is bigger than the cross sectional area of the chamber 137 with its sealing ring nose 431. Consequently, the force of fluid at equal pressure is greater below the thrust body than above the thrust body. Thereby the thrust body 432 is with its ring nose 431 strongly pressed against the membrane 58, and this secures a tight and reliable seal between the thrust body and the membrane. Chamber 437 is now tightly sealed, A spring (for example, a disc spring) 437 may be provided below the thrust body to assist the described sealing action at times when the pressure in the cylinder 11 is low.

FIG. 5 illustrates the thrust-chamber and thrust-body arrangement of FIG. 2 in a separate and enlarged view. One sees in FIG. 5 the important diameters "D", "d" and "delta d" of the thrust body with its ring nose 431. Also shown is the unloading passage 441 to unloading space 430. It secures low pressure in space 430 and thereby secures the difference of forces below and above the thrust body 432. The thrust body has a concentric bore for temporary reception of a portion of piston 5.

This prevents excessive dead space volume and is important in the gist of the invention. Also shown is the disc spring 437 in the disc spring space 438 of the thrust body 432. Important in FIG. 5 is also, that the seal ring chamber 433 is provided and contains in the preferred solution the metallic corner ring 434 with its tapered inner face to surround a plasticly deformable seal ring. It has appeared very often at practical testing and appears again and again, that the plastic seal ring deforms and travels against the direction of pressure. This is not imaginable, but it occurs.

The plastic seal ring then moves radially inwards, deforms, and the seal becomes untight. Therefore radially inwards holding rings 435 are provided radially inside of the plasticly deformable seal ring.

In FIGS. 3 and 4 respective corner seal rings 418,423 or 427 are provided in respective seal ring grooves 412,428,405,406, etc. which contain plastic seal rings 412,428,419,425,61,62. Again holding rings 429,420, 424 are provided in the seal ring grooves to prevent movement of the plasticly deformable seal rings in the direction against the pressure towards the respective pressurized chamber or thrust chamber. Such seal ring grooves are also provided adjacent membranes. FIG. 4 shows such a sealing arrangement of the invention of a bore 426 against a face of a body 408. FIG. 3 shows such sealing arrangements against a membrane 58. FIG. 3 illustrates that the oppositely of the membrane 58 located seal ring grooves 405 and 406 are radially offset relatively to those on the other side in order to prevent deformation of portions of the membrane 58 between adjacent grooves.

FIGS. 6 and 7 show the preferred embodiment of a piston shoe of the invention in separate illustration. The common swing center 546 is the root of the radii 460 and 461 of the faces 467 and 468. Radius 462 of the slide face corresponds substantially to the radius 463 of the eccentric piston stroke guide face of the eccenter-cam. Between the upper portion with face 468 and the lower portion with slide face 465 is the narrower neck of the piston shoe with the outer neck face 1463 formed. The piston shoe may also have axial end faces 470 which may be to each other parallel planar faces.

Figure 8:
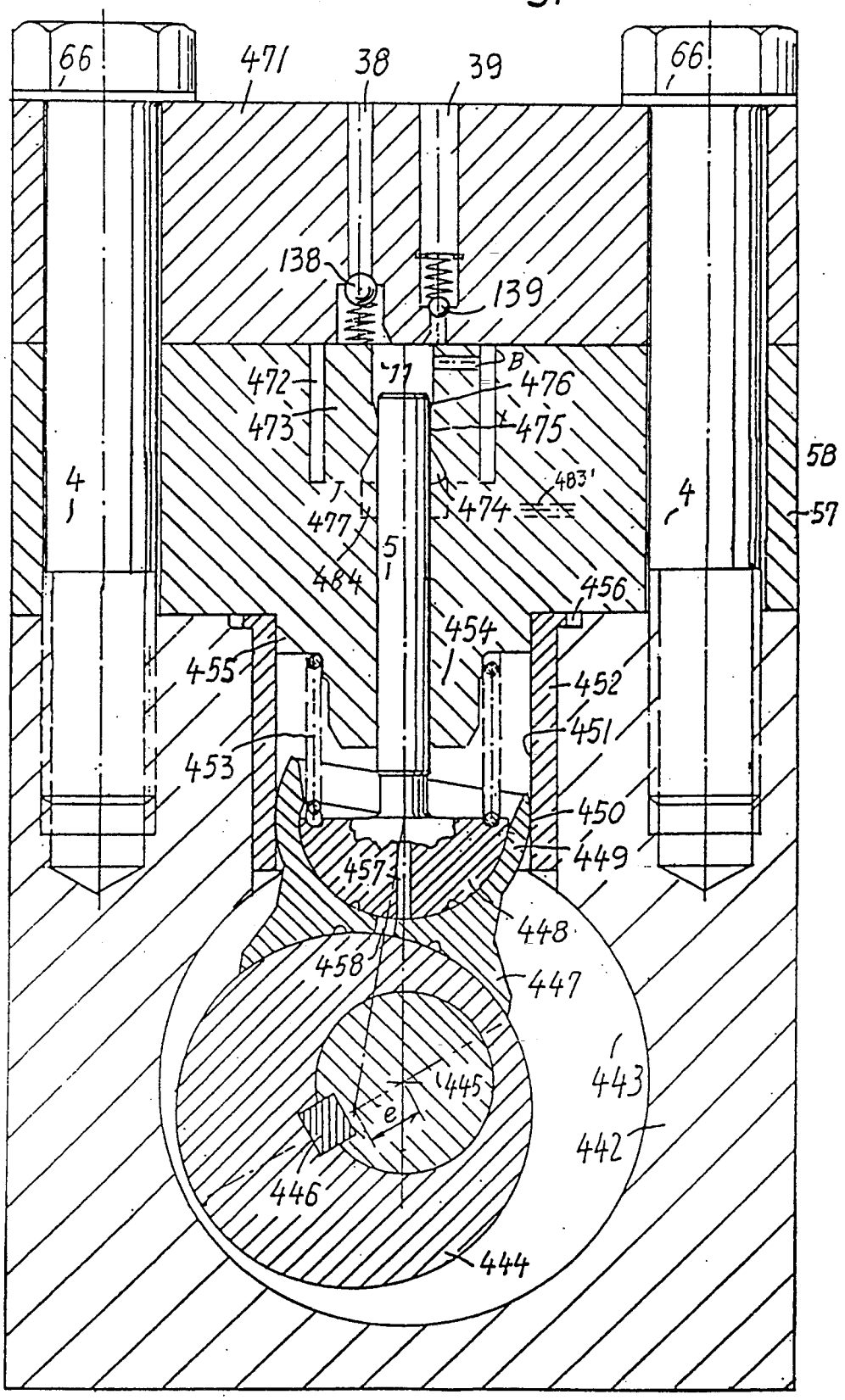

In FIG. 8 the piston 5 is surrounded partially by a self-sealing circular portion 473. A ring space 472 surrounds the ring portion 473. The ring space 472 communicates to the cylinder 11. Thereby the pressure in ring chamber 472 is equal to the pressure in the cylinder 11. Since the radial outer area of the ring portion 473 is larger than the radial inner area, the fluid presses the ring portion 473 radially together, whereby with increasing pressure the clearance between the inner face of portion 473 and the outer face of piston 5 narrows. Thereby a self-sealing effect for high pressure is obtained. Because at higher pressure, the sealing clearance around the piston 5 narrows. Preferred is, to make the radially narrowed portion in axial direction of a limited size 475. That is obtained by providing a chamber 484. The location and configuration of chamber 484 is shown in FIG. 8 by dotted lines. The ring portion may also be a bush, supported on the face 477. A desired pressure may be upheld in chamber 484 via passage 483'.

Figure 9:
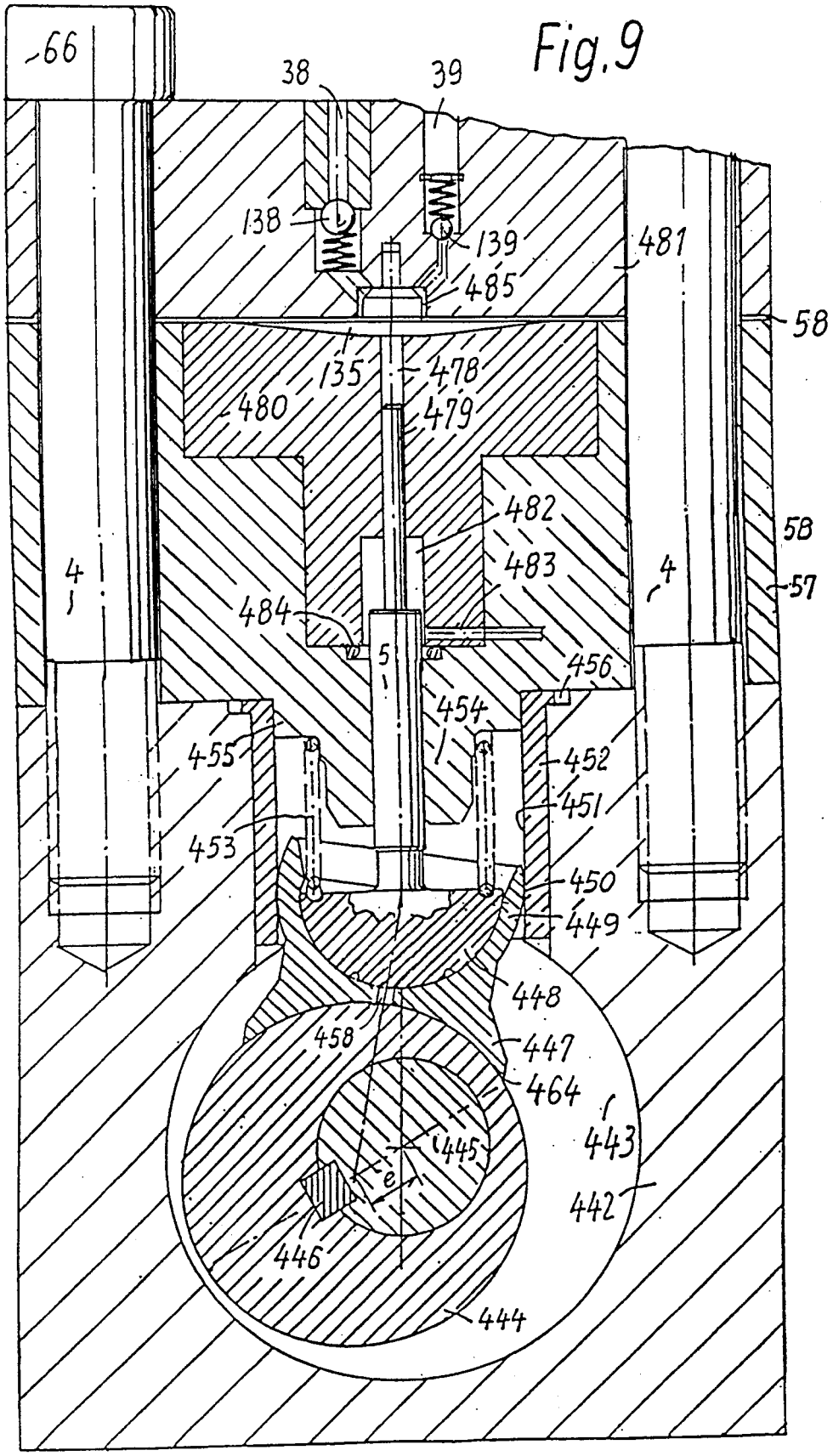

In FIG. 9 an insert 480 is provided in the cylinder block 57. This insert can be interchanged for insertion of different sizes of seals. It has a seal ring chamber 482 for the assembly of seals for piston 479. piston 479 may be associated to drive piston 5. Note that piston portion 479 is the high pressure portion with small diameter, while piston 5 is here in this Figure the drive portion of the piston and forms the piston foot. The drive portion 5 has the bigger diameter. A seal ring 484 may be provided to lead leakage of piston portion 479 through passage 483 out of the device. Portion 455 is a centering portion which centers the cylinder block in the guide bush 452 of the housing 442. High pressure cylinder 478 is communicated to the lubricating fluid pressure chamber 135 below the membrane 58.

Figure 10:
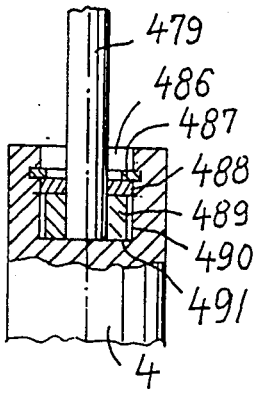
FIG. 10 illustrates a holding arrangement of the invention.

FIG. 10 shows the assembly of the high pressure piston 479 of small diameter in the drive piston 5. The drive piston 5 has a holding chamber 490 into which an enlarged foot 489 of piston 479 is inserted. A ring assembly 487,488 holds the piston foot 489 of the high pressure piston 479 inside of the drive piston 5.

Figure 11:
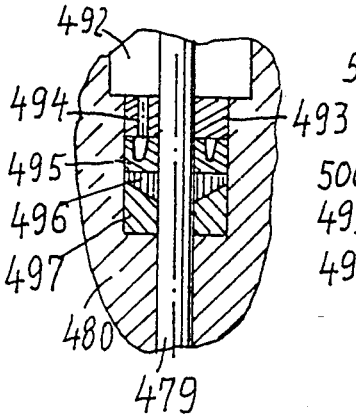
FIGS. 11 and 12 are sectional views through seal means for pistons of the invention.
Figure 12:
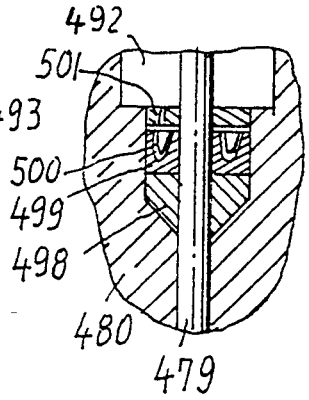

FIGS. 11 and 12 show sealing arrangements for the high pressure piston 479. They include a lip seal 495 or 500, a holding ring 494 or 501, a coned back up ring 496 or 498 with a tapered rear face.

According to FIG. 11 a complementary formed rear tapered ring 497 supports the back up ring 496. The sizes and angles of the rings and tapers are important to obtain a good seal without sticking and welding.

FIG. 13 shows the piston shoe of the invention provided in an axial piston device. The axial piston 5' in cylinder 11' has the piston foot 448 and the cylinder block 502 is provided with a substantially axially directed guide space 559' with the guide face portion(s) 451'. The piston shoe 447' has again the faces 467 and 468 of FIG. 7. But the part cylindrical face 465 of FIG. 6 is replaced in FIG. 13 by the planar slide face 504. This slide face 504 runs on the plane piston stroke guide face 505 of the inclinable piston stroke guide body 503.

Figure 14:
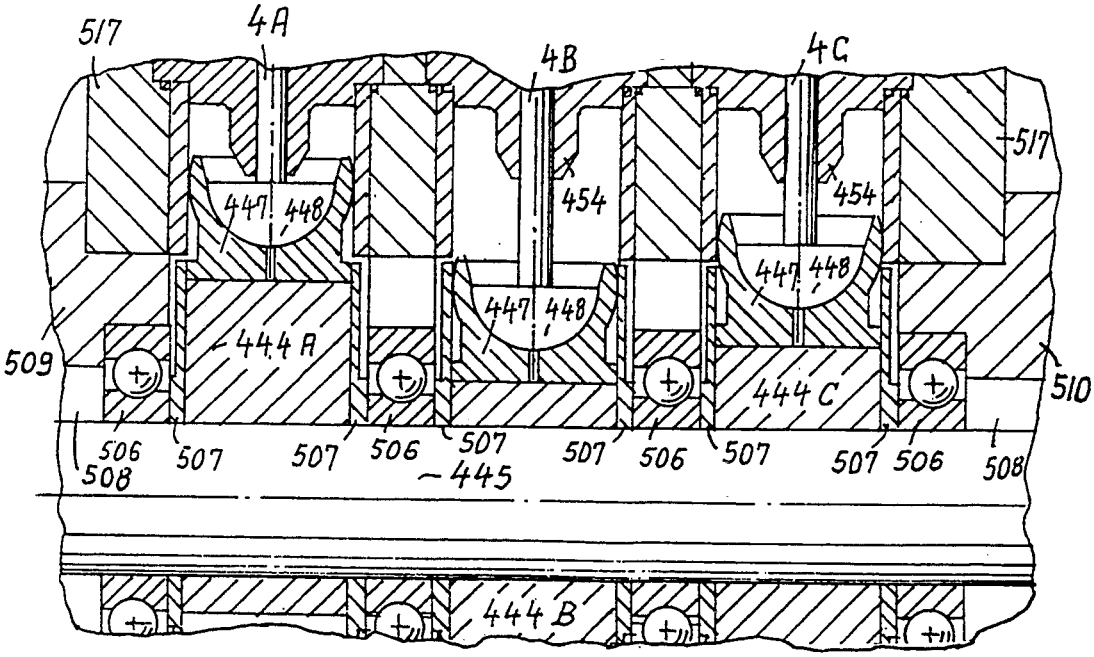
FIG. 14 is a sectional view through another portion of the invention.

FIG. 14 illustrates that plural pistons and shoes, or groups thereof, may be provided axially of each other about a revolvable shaft 445. Shown are eccentric cams 444A, 444B and 444C on which respective piston shoes 447 are guided to drive the power strokes of pistons or of piston groups 5A, 5B, 5C in cylinders 11A, 11B or 11C, respectively.

The drive assembly may be kept by covers 509.510 in housing 517.

Figure 15:
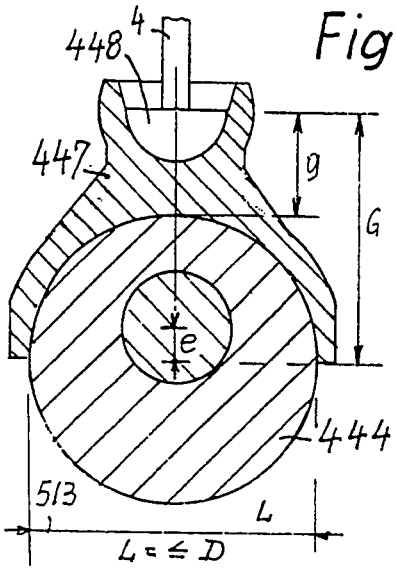
FIGS. 15 and 16 are sectional views through portions of the invention.

FIG. 15 shows the arrangement of the invention for the highest possible pressure. The piston shoe is here peripherially extended to embrace almost 180 degrees of the piston stroke guide face of the cam 444. Thereby the length "G" from the common swing center to the lower end of the piston shoe may become longer than the closest distance from the swing center to the piston stroke guide face of the cam. The piston shoe obtains by this arrangement the most stabile guide and obtains also the most bearing power of its slide face. The slide face of the piston shoe in this way obtains the maximum of bearing land area. The peripheral extension of the slide face can so become a maximum of "D pi/2" with "D"=diameter of the piston stroke guide face of cam 444.

Figure 16:
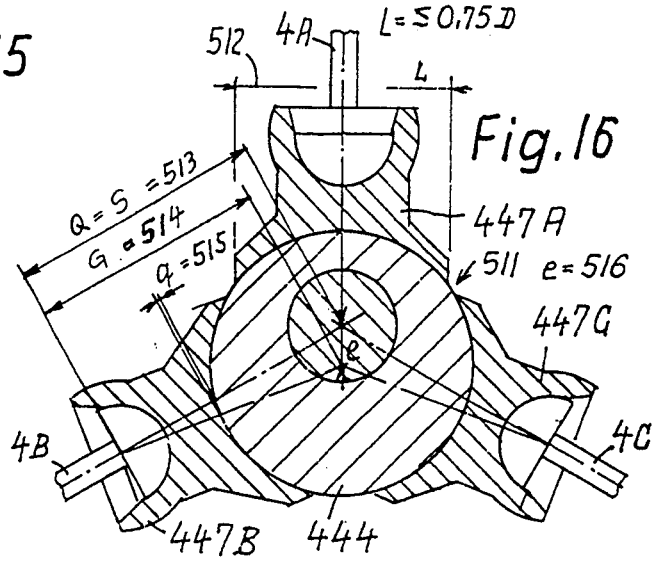

In FIG. 16 three cylinders and pistons with piston shoes are provided to one single eccentric cam 44. See piston shoes 447A to 447C. The Figure shows the geometrical relationships "e", "G", "Q", "q" and "L" which are important for the calculation of the details. The hereto belonging details are contained in the respective RER-reports of the research institute Rotary Engine Kenkyusho of 2420 Tsshiki, Hayama=machi, Japan. The advantage of FIG. 16 over FIG. 15 is a better uniformity of flow. The disadvantage of FIG. 16 relative to FIG. 15 is, that the slide faces of the pistons shoes are shorter in FIG. 16 and the bearing power for high pressure is therefore smaller in FIG. 16 than in FIG. 15.

Figure 18:
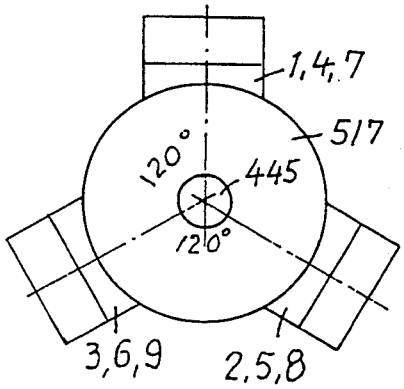
FIGS. 17 and 18 show pumps of the invention seen from their rear.
Figure 17:
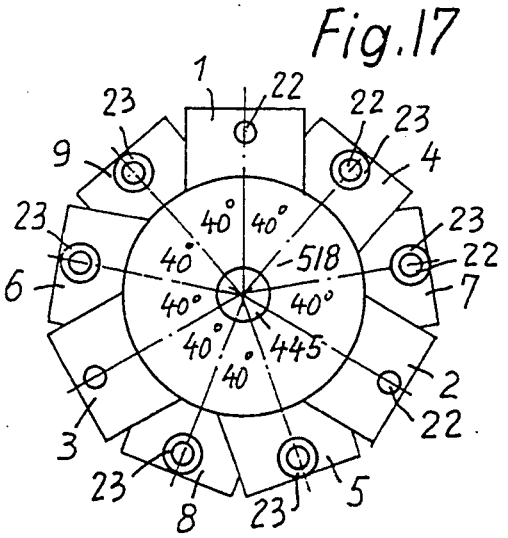
Figure 19:
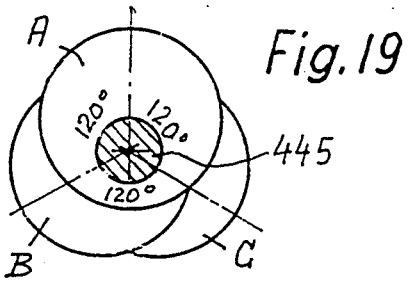

FIGS. 17 to 19 illustrate important matters of 9 piston devices of the invention. 9 pistons give a high uniformity of flow and can spare the accumulators of water jet devices. Three piston groups, of three piston each, are provided in these 9 piston devices. In FIG. 17 the cylinders are angularly spaced by 40 degrees. In FIG. 18 they are angularly spaced by 120 degrees and the three groups are behind each other.

Figure 20:
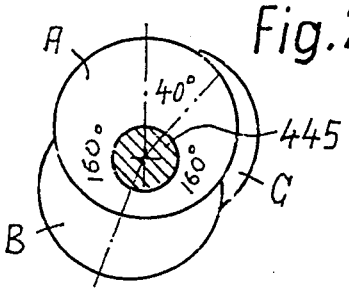
FIGS. 19 and 20 are sectional views through a shaft of the invention.

In FIG. 17 the cams for the three groups are angularly spaced by 120 degrees as shown in FIG. 19. But in FIG. 18, the invention discovers, that angularly spacing of the cams A,B,C by 120 degrees can not provide uniform flow. According to the present invention, in FIG. 18 the cams A,B,C must be angularly spaced as shown in FIG. 20. That means that cam "B" is 160 degrees turned relative to cam "A", cam "C" is angularly turned 160 degrees relative to cam "B", but cam "A" is angularly turned relative to cam "C" by only 40 degrees. If this arrangement of the invention is obeyed, then a very uniform flow is obtained by the 9 piston device with 3 piston groups.

FIG. 21 shows at which angles of rotation of the shaft which piston starts its delivery stroke. "Hubstart" in this Figure means start of the delivery stroke or power stroke of the respective piston.

In FIG. 22 the power strokes of the respective pistons of FIGS. 18 and 20 are shown over the respective angle of rotation of the shaft of the device. The angle of rotation is indicated by "$\alpha$"=greece alpha.

In FIGS. 23 to 25 it is shown that the angular arrangements of FIGS. 18 and 20 can also be done in a device, wherein a rotor 518 has the cylinders and the control of flow is done by a control body 517. It is also possible that the body 518 is stationary, while the controller 517 revolves. The cylinders of the 3 groups, namely cylinders 523,524,525, are axially behind each other as in FIG. 18. The control ports 529 to 531 of the controller 517 must then, in accordance with the present invention, be angularly spaced relatively to each other, as the cams are in FIG. 20.

Namely 160 degrees between two control ports and in one single case 40 degrees between two control ports. In FIG. 25 the axes of the control ports are drawn in the same angles as the medial lines through the cams of FIG. 20. This angular arrangement is very important according to the invention, because at such high pressures, the power and noise are also high. An uniformity of flow is then highlier desired as in low pressure applications.

Figure 26:
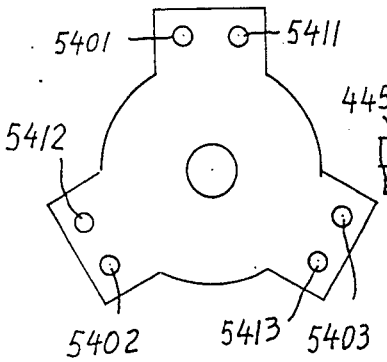
FIGS. 26 to 28 show a pump of the invention in different views.
Figure 27:
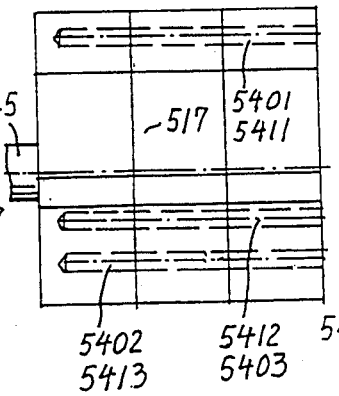
Figure 28:
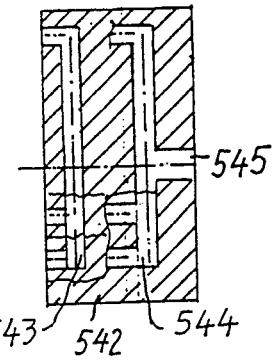

FIGS. 26 and 27 illustrate, how the entrance- and exit-fluid lines are located through a device of FIG. 18. FIG. 18 shows a cover which may be set onto the end of the three group device of FIGS. 18,20,26 or 27 and which obtains, in FIG. 18, communication passages 542 to 544 to the passages of FIGS. 26 and 27. A port 545 communicates to a plurality of the passages.

Figure 29:
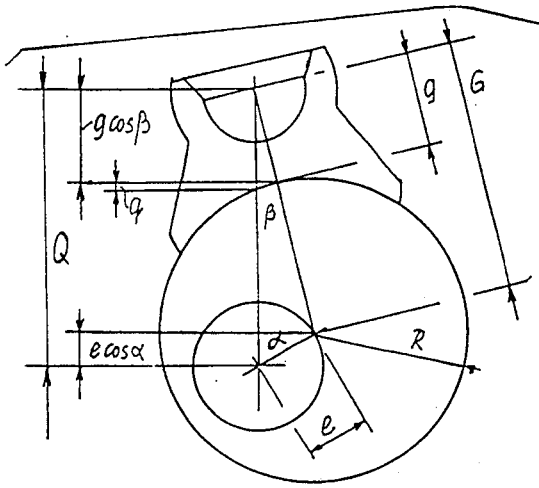
FIG. 29 illustrates a geometric-mathematic relationship of the invention.

FIG. 29 shows some geometrical data and the mathematical equations for the calculation of the details of the device of the invention. Calculated therein are also the stroke, the velocity and the acceleration of the respective piston.

Figure 30:
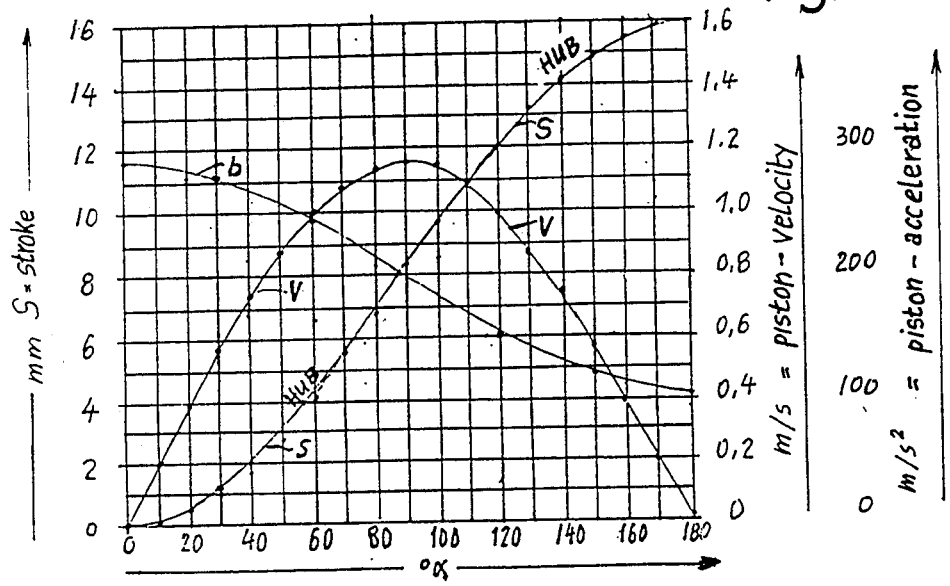
FIG. 30 shows a diagram.

FIG. 30 shows in a diagram the piston-stroke "S", the velocity "V" and the acceleration "b" of the piston over the rotary angle "alpha" of the shaft of the device.

In FIG. 31 the diagram shows nine pistons of FIG. 18 in action over the rotary angle "alpha". In the upper portion of this Figure the summarization of the velocities of the respective pistons is given. The uniformity or ununiformity of this velocity summarization gives the uniformity or ununiformity of flow.

Figure 41:
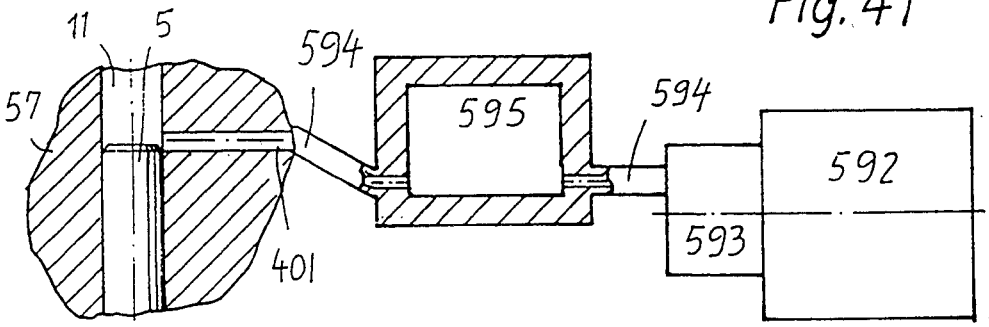

In the lower portion of FIG. 31 is shown that the pistons start deliveries late, namely after about 20 degrees of revolution. This illustrates the important discovery of the invention, that the delivery starts only after so many degrees of revolution, that the fluid in the cylinder is fully compressed to the high pressure of one or of several thousand atmospheres. The dotted lines 596 in FIG. 31 illustrate that the uniformity of flow can still become more even, in accordance with the present invention, if an arrangement of FIG. 41 becomes provided, Therein a pre-pressure pump 593 or an accumulator 595 fills the cylinder 11 at the moment of the lower dead point of the piston 5 over passage 594,401 with the final high pressure. Then no fluid-compression stroke is needed any more and the delivery of the respective piston starts immediately when the upwards stroke of the piston begins. The very even flow of fluid, according to line 596 of FIG. 31, is then obtained.

Figure 34:
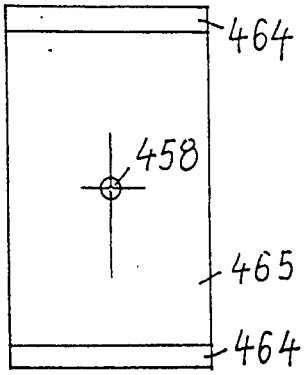
Figure 40:
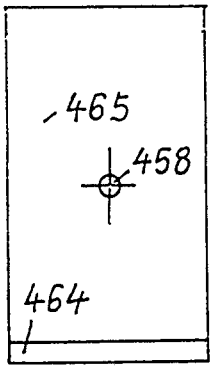
Figure 32:
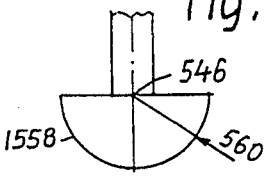
Figure 35:
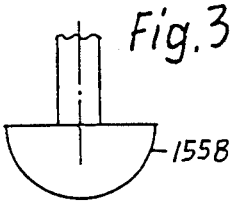
Figure 38:
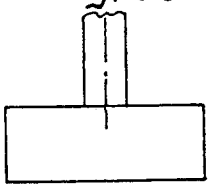
Figure 33:
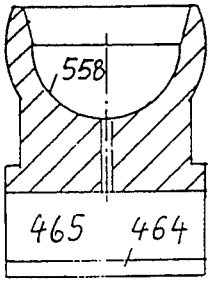

FIGS. 34 to 39 illustrate several modifications of the piston feet and piston shoes of the invention. In FIGS. 34, 37, 32, 33, 35 and 36 the piston feet and beds of the piston shoes are part-spherically configurated. But in FIGS. 38 and 39 the piston foot and the bearing bed of the piston shoe are part-cylindrically formed. In FIGS. 34 and 33 the slide face of the piston shoe acts hydrodynamically by the provision of inclined end face portions 464. In FIG. 40 one has an inclined face to provide hydrodynamic bearing only in one of the two directions of movement.

Figure 37:
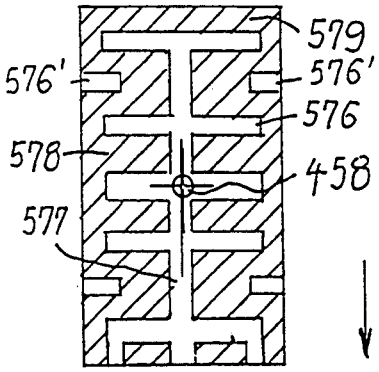

FIG. 37 shows the slide face of the piston shoe which has proven its reliability up to 4000 atmospheres. It has the perpendicular recess portions 576 in the normal=-perpendicular direction relative to the direction of the movement of the slide face on the piston stroke guide face. Groove 577 collects ingoing lubrication fluid from the inner space 443 of the housing and leads it into the perpendicular recess portions 576. Thereby all bearing lands between the perpendicular recess portions 576 and 576 or 576' are suitably lubricated. Note that it is most important that the interior space 443 of the housing 442 must be filled with good lubrication oil. Otherwise the system of FIG. 37 can nort work for several thousand atmospheres.

FIGS. 42 and 43 show that guide bush portions 601,602 can become set around the part spherical face portions 461 of the piston shoes. Then the guide means which run along the guide faces 451 become part cylindrical faces 609. They can contain fluid pressure balancing pockets 607 with thereto leading passages 606.

For extremely high pressure the guide means 450 of the piston shoes become very long lines, if the radii 461 are large. Note that the radii 461 can even become larger than the radii 463 of the stroke guide faces 570 of the cams 444. Then the guide means 450 are very long lines and the neighborhood of these lines forms inclined face portions which form angles for a good hydrodynamic lubrication of the guide line-guide face portions 450. That provides the lateral guidance of the swinging piston shoe. The piston shoe swings around the swing center, while it remains effectively guided on wall portions 451. Note that the oil level of the lubrication fluid in the interior space of the housing must be above the guide means 450 to properly lubricate the guide line 450 with guide face 450' as well as the guiding face portion 451. Occasionally the interior space 443 may require a pre=pressure "Pp" in the lubrication-fluid.

Figure 44:
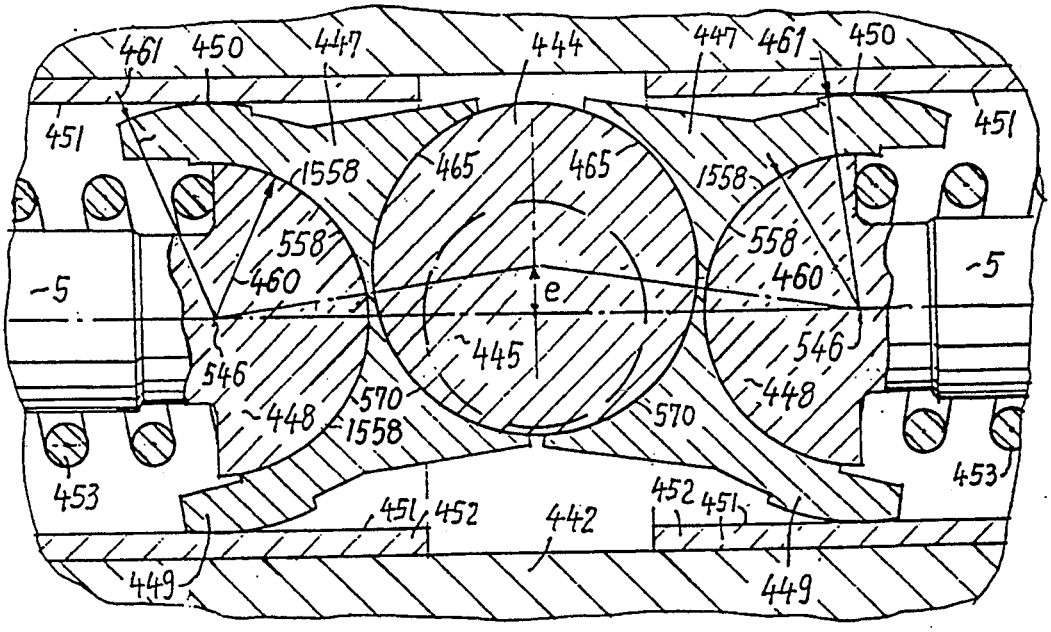

FIG. 44 illustrates the already at hand of earlier Figures described piston shoe arrangement of the invention, with the specifity that two piston shoes are opposed located relative to the cam 444. Thereby it is seen that the guide face 465 of the piston shoe may extend almost 170 degrees along the periphery of the cam, in other words, along the piston stroke guide face 570 of the drive cam 444. The feature of this arrangement is the capability of extremely high pressure, the extension of the 461 to the size of the radius of the guide face 570 or to an even longer radius 461, whereby a strong guide face 451 and guide means 450 is obtained, while at the same time the multiple piston drives reduce noise and reduce the ununiformity of flow. The arrangement can also be used to synchronize the velocities of driven members, for example of lifting rams or the like.

Figure 45:
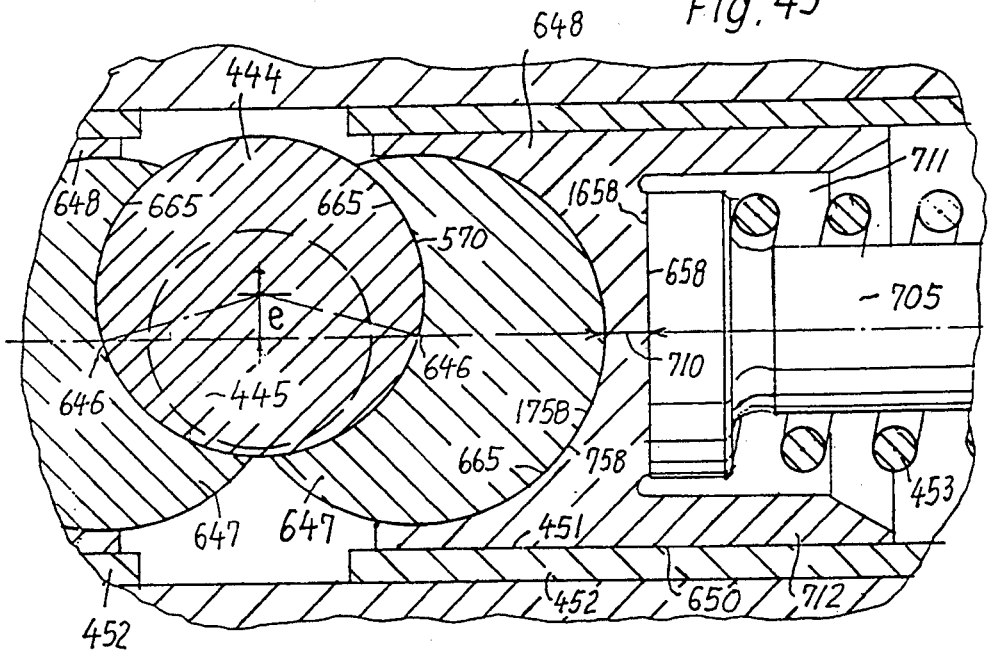
Figure 46:
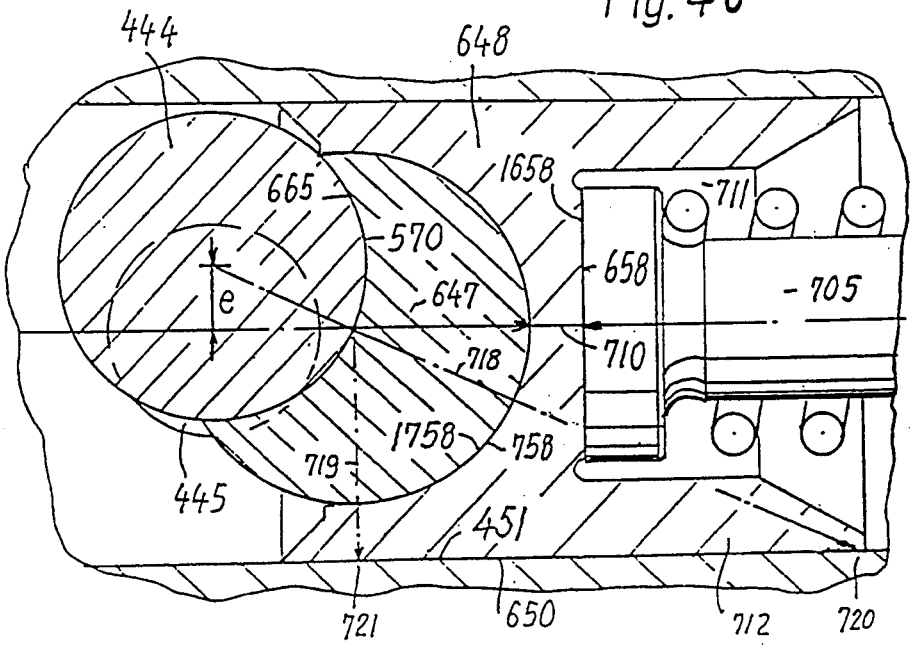

In FIGS. 45 and 46 the piston shoe 647 is embedded by its swing face 758 in the pivot-bed 665,1756 of a piston 648. The piston is hollow on the opposite end to form a seat 656 for a transfer piston 705. Piston 648 is then the drive piston with its guide face 650 carrying the lateral load on the guide face 451, while the transfer piston 705-1658 enters deeply into the socket-bore 711, with the long lateral guide portions 712 embracing or surrounding the bore 711. The dotted line 718 indicates that the resultant of forces from the eccentric cam goes through the guide portion 712 of the drive piston 648, meeting the guide means and face 650,450, at point 720, which shows that an extremity of stability of guidance is obtained by the arrangement of FIG. 46. FIGS. 47 to 53 show sectional views through embodiments of the invention which can be understood at hand of FIG. 61.

FIG. 61 shows the equation for calculation of the detailed local deformations of a cylinder under different pressures radially from inside and outside. For this situation the english language literature and the english language catalogues of respective firms are relatively primitive and unaccurate. In the equation "u" defines the local deformation, and the equation reads:

$$u = \frac{(m-1)(r^2Pi - R^2Po)\mathfrak{Z}}{mE(R^2 - r^2)} + \frac{(m+1)r^2R^2(Pi - Po)}{mE(R^2 - r^2)\mathfrak{Z}} \quad (1)$$

Therein

"m" is the reversal of Poisson's ratio, while "E" is the modulus of elasticity.

R is the value of the outer diameter;

p=pressure r is the value of the inner diameter, and i=inside,

O=OUTSIDE $\mathfrak{Z}$ is the actual radius of the local place which is calculated.

Therein "$\mathfrak{Z}$" is the japanese "ro" in hiragana. This value can be the outer radius "R", the inner radius "r" or any other radius therebetween.

It is easy to use "mm" and "Kg/mm" in this equation.

The equation is found in japanese litarature. By calculating with it, the present invention disvovers, that due to the pressure drop in cylindrical clearances, the cylindrical bush decreases its inner diameter with increasing distance from the entrance of the high pressure fluid. That would lead, as the invention discovers, to sticking of the piston in the cylinder, if the inner diameter of the bush or cylinder would be cylindrical throughout its length, if outside of the cylinder or bush acts the same fluid pressure as at the entrance to the sealing clearance.

Figure 62:
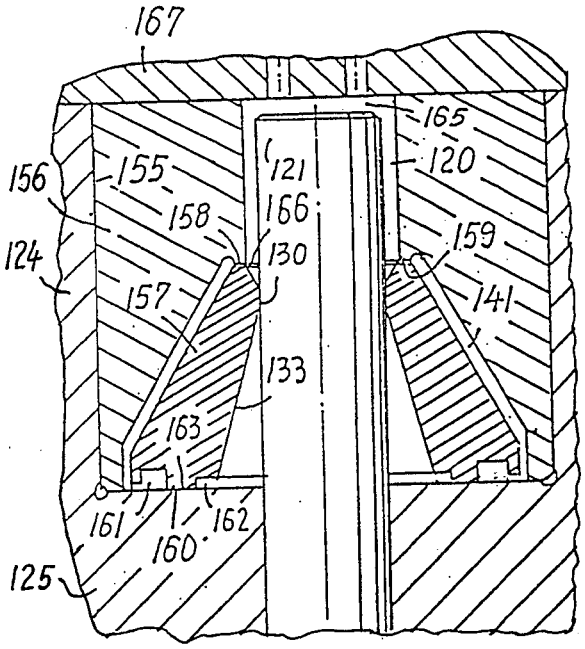
Figure 63:
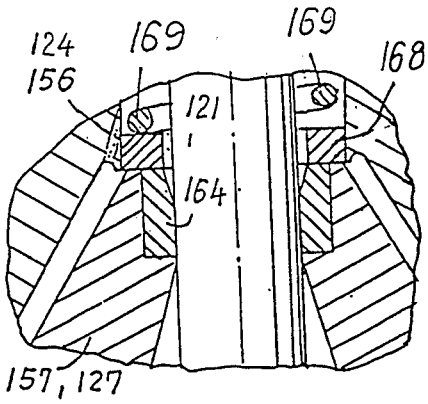
Figure 47:
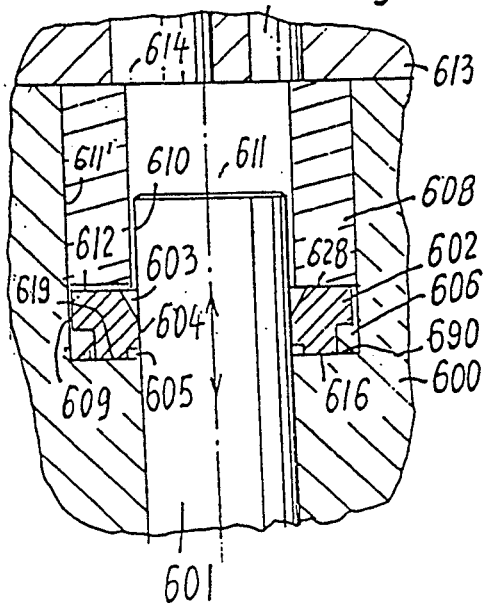
Figure 48:
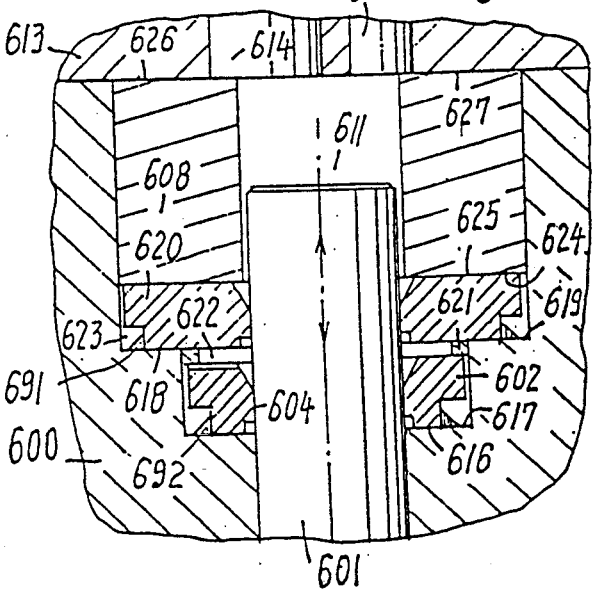
Figure 49:
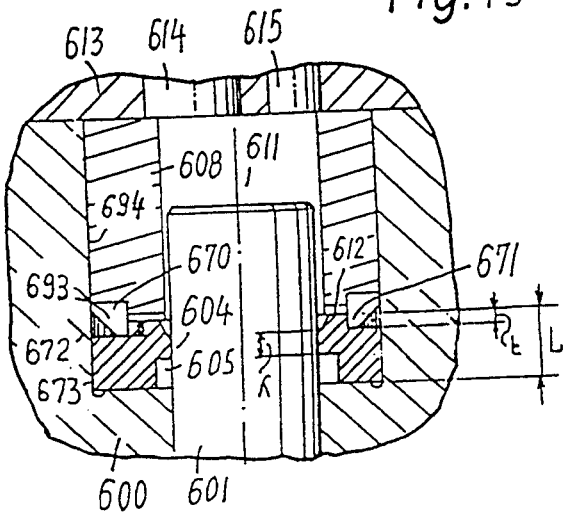
Figure 50:
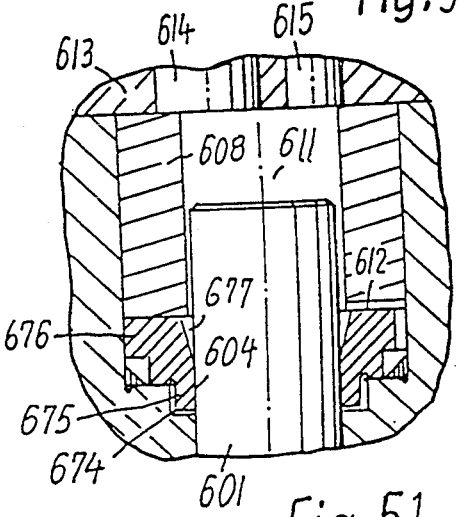
Figure 51:
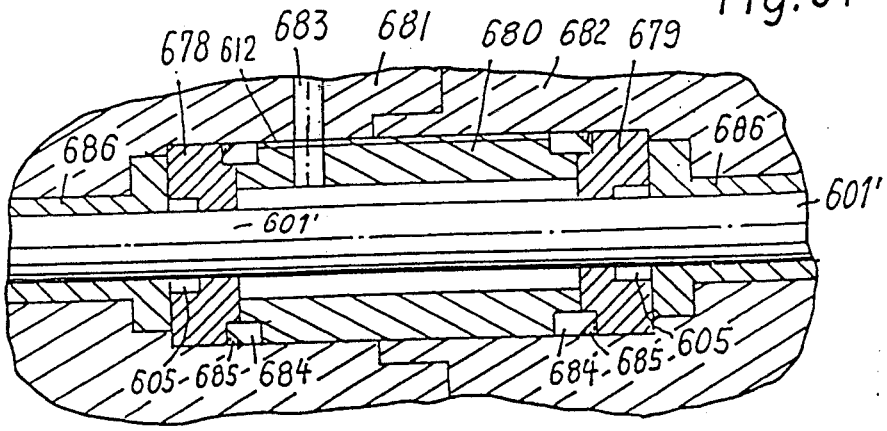

FIGS. 62 to 63 therefore illustrate the discovery of the invention, that for sealing of a piston a chamber 141 should surround a portion 157,127 of a cylinder or of a bush and be connected to the high pressure area, 120, against which the piston 121 acts. The portion of bush will then become compressed due to the pressure radially outside of the bush or cylinder. Since the pressure difference between inner- and outer-pressure increases in the clearance around piston 121 with increase of distance from entrance 166,120 of the bush or portion, the present invention provides an entrance-flow portion 129 which narrows in diameter parallel to the exial distance from the entrance 166 of the sealing clearance. On the end of the entrance-flow portion follows the primary seal portion 130 and on the other end of the seal portion 130 the inner diameter of the bush widens, to form an endwards wider taper-cone 130. This cone on bush 127,157 prevents the sticking of the piston in the bush. The angle of the taper is so designed that at the desired pressure, the rear portion of the bush or portion 127,157 is just so much compressed, that an ideal narrow clearance appears between the piston 121 and the inner face of the bush or portion of the cylinder. Sticking is thereby prevented, while the best seal without friction of plastic seal rings is In FIG. 64 the portion 127 is a seal portion of cylinder 125 In FIG. 65 portion 56 is a seal portion of cylinder 49, while in FIGS. 62 and 63 the members 127,157 are bushes. FIGS. 62 and 63 further illustrate the preferred style of holding of the bushes by ring means, faces and grooves, holders or springs in the respective device which is to be sealed. Such holding or improving means are shown by referentials 156,158,159,160,163,161,162,163,164,168 etc. in FIGS. 62 and 63.

Figure 64:
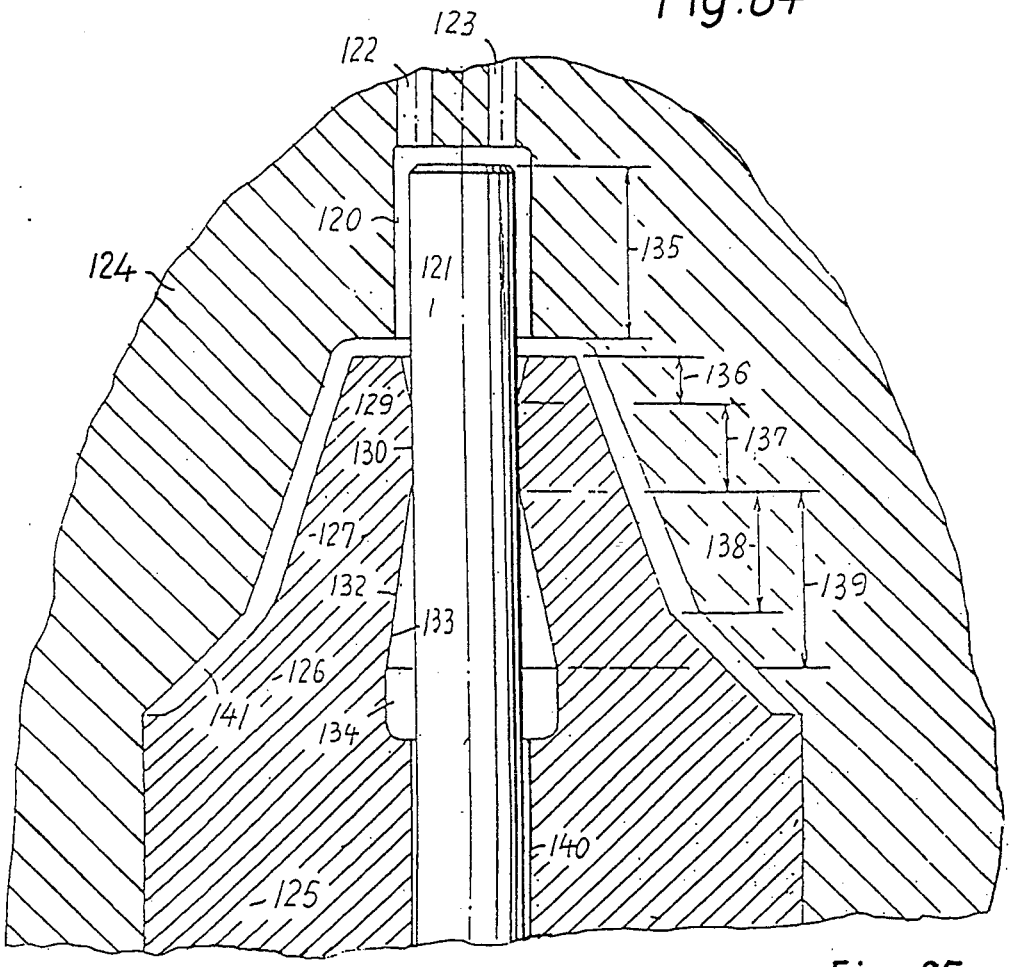
Figure 65:
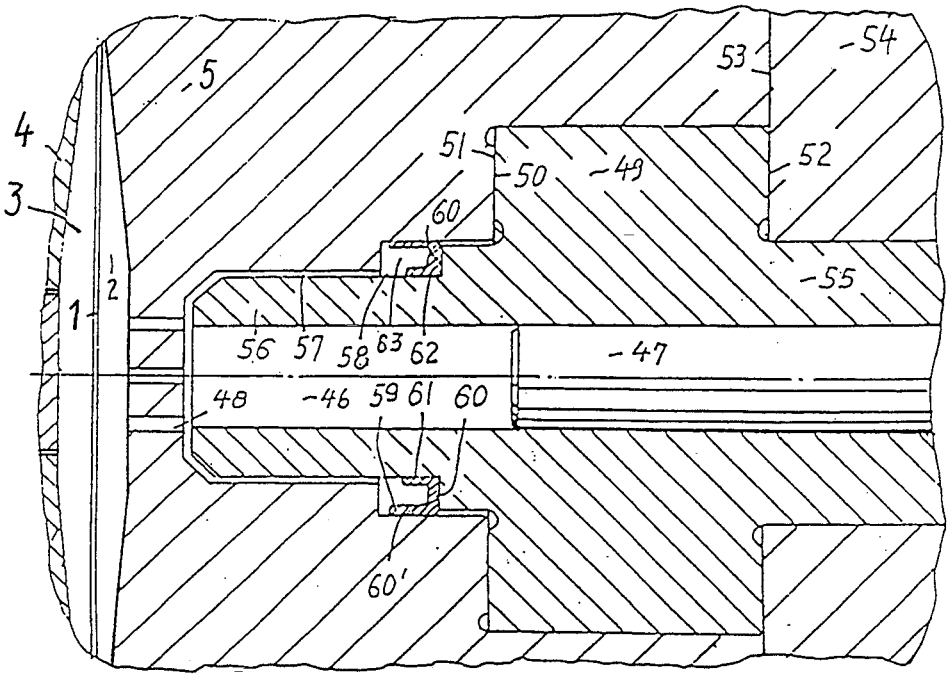

FIGS. 64 and 65 show cylinder portions 56,127 assembled into devices for sealing of pistons 121,47 by utilyzing equation (1). Since the taper 132.133 is actually very small, namely so small that it can not be recognized by the human eye, in FIGS. 64 and 65 the tapered form is seen cylindrically.

FIGS. 47 to 51 illustrate in sectional views seal rings or bushes in accordance with the invention and under design by calculation at hand of equation (1). While the referential numerals may be different, the gist of embodiments of FIGS. 47 to 51 corresponds to that of the discussed FIGS. 62,63 etc..

FIGS. 47 to 50 also show that the bushes 602,620,670 may be axially short to reduce unsecure sealing areas and that corner seals 690,691 and the like in similarity with the corner seals of FIGS. 3,4 etc may be provided to the seal ring bushes as well as respective holding bushes 610 etc..

Figure 52:
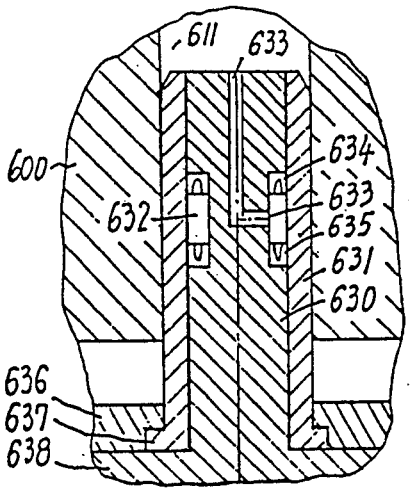
Figure 53:
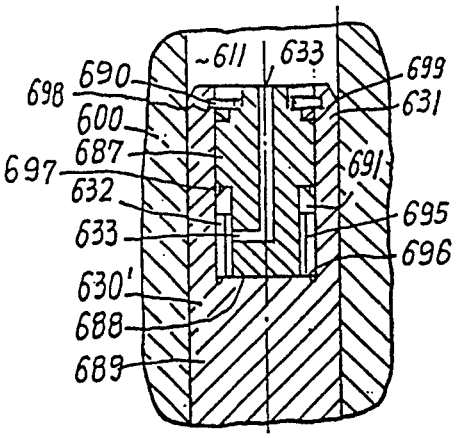

In FIGS. 52 and 53 the invention creates radially deflecting seal ring portions on hollow pistons 630,689. Interior space portions 632 are provided in the pistons according to the present invention and are communicated to the interior of the cylinder 611. The pressure in spaces 632 is the higher than in the clearance which surrounds the piston's wall radially outside of space 632. The respective portion of the wall of the hollow piston then bows radially outwardly under the difference of the pressures inside and outside of the respective portion of the piston. That results in narrowing the sealing clearance around the piston and thereby in reduction of the leakage through the clearance between body or wall 600 and the respective piston 630 or 689.

Figure 54:
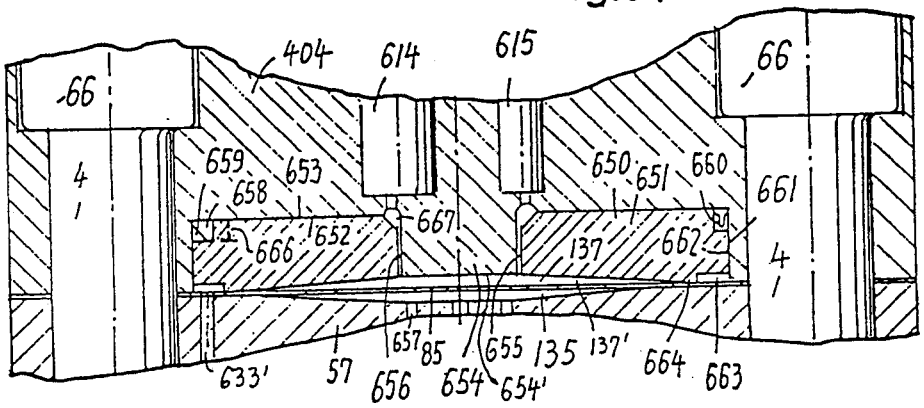
Figure 55:
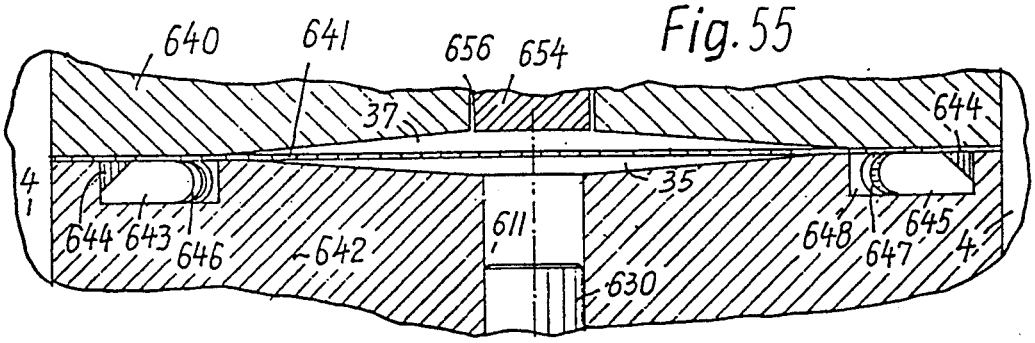

FIGS. 54 to 60 illustrate sectional views through thrust chambers with therein provided thrust bodies. These arrangements may have different referential numerals, but their gists, structures and purposes are substantially similar to respective members of FIGS. 2 or 5. In FIG. 54 the thrust body 654 has the ring-nose seal portion 664, the seal 659 for sealing against the wall of the thrust chamber and the faces 652,653 hold the thrust body axially in place at assembly. The thrust body 651 has a centric bore 656 for the reception of portion 654 of body 404. A narrow clerance 656 is formed between bodies 654 and 651 to prevent entering of membrane 58, but to permit inflow from entrance 614 through 667 and 656 into working chamber 127 and outflow in opposite direction to and through outlet 615.

In FIG. 55 the portion 654 is again provided in a bore 656 with a respective clearance 656 which communicates with working chamber 37. For sealing of the membrane 58,641, the seal ring groove (annular) 643 is provided to contain a plastic seal ring 645. Corner seal 644 is again the coned ring of the invention and it prevents extrusion of the plastic seal ring radially outwardly. The bowed rings 646,647 are holding rings in accordance with the discoveries of the present invention to secure that the plastic seal rings can not move radially inwardly out of the groove 643. It is an important discovery of the present invention, that the seal rings actually do move radially inwardly in the direction against the pressure in chamber 35, if the holding rings 646, or 647 are not provided as holding rings to hold the plastic seal rings. Holding rings may be opposed "C" form or "V" form shaped and may be thin because they do not need to be strong. Thin-ness makes them better flexible.

Figure 56:
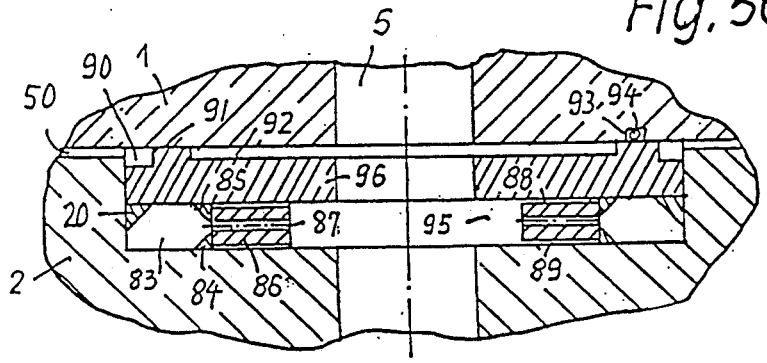

In FIG. 56 the thrust body 95 is a ring with medial bore 5 and with the sealing ring nose 91. In the opposed face a seal groove 93 with seal ring 94 may be provided and be covered by the planar face of the ring nose 91 of the thrust body 96. Rearwards of the thrust body is a holding or distance-ring 86 provided and coned corner seal rings 20,84,85 are provided to prevent undesired movements of plastic seal rings or of portions thereof.

Figure 57:
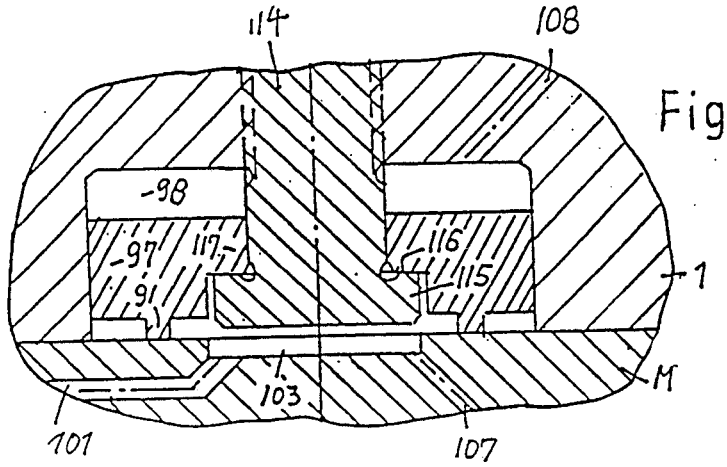

In FIG. 57 thrust body 97 is located in thrust chamber 98 with sealing ring nose 91 of the thrust body sealing against the planar end face of body 11. The thrust body 97 gas again a concentric bore and forms a seat 117 for holding the thrust body by flange 115 and its face 116 on seat 117 of the thrust body, while the member 114 is kept in body 1 and extended partially through the bore of the thrust body to form the mentioned holding means 115 to 117.

Figure 58:
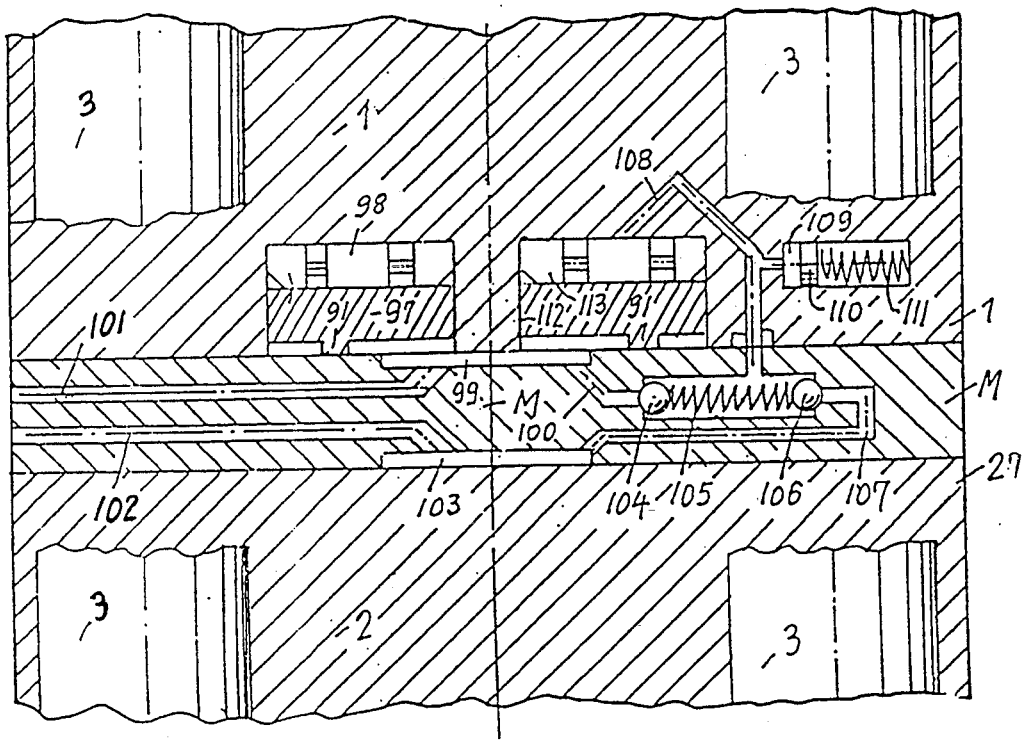

In FIG. 58 the thrust body 97 is located in thrust chamber 98 and seals with its ring nose 91 against the medial plate "M". The aim of FIG. 58 is, to keep the bolts 3, which keep the plates 1,M,2 together at all times of operation under constant strain to prevent elongation and/or alteration of the bolts 3 under alternating load. The invention obtains this aim in this Figure by leading alternatingly the high pressure from chambers 99 and 103 into the rear of the thrust chamber. Since high pressure is acting in chamber 99, when low pressure is present in chamber 103 (and vice versa), the thrust chamber 98 becomes communicated by passage 108,107 to chamber 103, when high pressure is present in chamber 103. But the thrust chamber 98 becomes communicated by passages 108,100 to chamber 99, when high pressure is present in chamber 99. Thus, the thrust chamber 98 has according to FIG. 58 of the invention at all times the highest pressure of the respective chamber of the device.

FIGS. 59 and 60 show different thrust bodies 128 in thrust chambers for sealing with ring noses 142 against membranes 1. The thrust bodies form radially inwards of the mentioned ring noses with faces 141 the working chambers 2. The faces 141 should have the configuration of Eickmann publications in order to prevent breaking of membranes 1 but obtaining maximal delivery volumes under the deflections of membrane 1. Seals, bores, springs, holding or bearing faces and the like are associated to the thrust bodies as shown by the respective referential numerals in these Figures.

FIG. 66 shows a sectional view through a portion of a seal ring groove with a therein located corner seal 644, a space 40 for the plastic seal ring and a holding ring 60 for prevention of radial inward move of the plastic seal ring. The holding ring has a disc-spring portion 60 with an axially directed extension 62. The corner 144 meets the adjacent face and an undercutting 143 secures a sharp cornered holding line 144. Clearance 147 secures the moveability in axial direction and the spring-action-ability of portion 60. The sealing arrangement of the invention provided by FIG. 66 is perfect, also for ver high pressure, but it is not the most inexpensive solution.

What is claimed is:

1. A high pressure device with its volume periodically varying fluid handling chamber (11,35,37,135,137) which is located in a fluid flow handling means (38,39,138,139,5,11) containing body (57,44), wherein said body forms a thrust chamber (438,650) which communicates to said fluid handling chamber and is closed by a plate (58,404,57), while a thrust body (432,651) is axially moveably sealingly fitted in said thrust-chamber and provided with an annular seal face (431) which meets and seals along a portion of the adjacent face of said plate (58,404,57,471), and wherein an unloading recess (430) is formed around said seal face (431) and communicated to an unloading passage (441) to keep the cross sectional area which is given by the outer diameter "d" of said seal face smaller than the cross-sectional area of said thrust-chamber, and, or; wherein a bore (111,656) is provided in said thrust-chamber (438,650) for the reception of at least a fluid from said thrust-chamber.

2. The device of claim 1,
wherein a portion (5,654,630) of a body (piston) enters at least temporary and partially into bore (111,656) of said thrust body.

3. The device of claim 2,
wherein a portion of a piston (5) periodically enters into and departs from said bore (111,656).

4. The device of claim 2,
wherein a portion (654) of a body (404) is permanently provided in said bore (656) and forms a narrow annular clearance (656) between the inner face (654) of the wall of said bore and the outer face of said portion whereby said clearance may communicate the entrance and exit means (38,39,138,139,614,615) to a fluid handling chamber (137).

5. A device capable of reciprocating a piston in a cylinder for the delivery of a flow of fluid under high pressure,
wherein said piston is driven by a piston shoe while said piston shoe is pivotably meeting a portion of a piston and driven to a reciprocating and pivoting movement by a piston stroke guide face 570 of a piston stroke providing body 444, wherein said body is revolved by a shaft 446 which is revolvably borne in a housing 57, wherein said piston shoe forms a slide face 465 which is complementary configurated respective to a portion of said piston stroke guide face, wherein said piston shoe forms a guide portion and a drive portion with said drive portion providing said slide face and remaining at all times outside of said cylinder, while said guide portion of said piston shoe reciprocates at all times at its operation at least partically in a cylindrical, to said cylinder co-axial cylindrical chamber, which chamber forms by its inner wall a cylindrical guide face, and, wherein said guide portion of said piston shoe forms a part-ball configurated outer face which forms by alternating portions of said outer face a circular line which meets alternatingly different portions of said cylindrical guide face for guidance of said piston shoe on said cylindrical guide face at all times of said reciprocation of said piston.

6. The device of claim 5, wherein three piston groups are provided with each group containing three pistons reciprocably provided in a respective cylinder, wherein said piston groups are provided axially of each other, wherein each of said piston groups is provided with a drive means to drive the power strokes of said pistons, and, wherein said drive means of the second piston group is subjected to a 120 degrees turn delayed start of the piston strokes relative to the first of said piston groups the drive means of the third of said piston groups is subjected to a 160 degrees angular delay of the power strokes relative to the power strokes of said second piston group, while the drive means of said first piston groupd is subjected to an angular delay of fourty degrees of start of the power strokes relative to the starts of the respective power strokes of said third piston group.

7. The device of claim 5, wherein said cylinder 11 is communicated to a chamber 135, while said chamber 135 is closed by a plate 58,404, wherein seal ring grooves 405,406,412 are provided in the body 57,404 which is adjacent to said plate while said seal ring groove contains a plasticly deformable seal ring, and, wherein coned corner seal rings 418,423,427 are provided in said grooves radially outside of said seal rings to prevent extrusion of portions of said seal rings radially outwardly in the direction away from said chamber 135, while stopper rings 420,424,429 can be provided radially inward of said seal rings to prevent movement of portions of said seal rings radially inwardly against the pressure of said chamber and towards said chamber 135.

8. The device of claim 5, wherein said housing forms an inner space, wherein said inner space of said hausing contains a lubrication fluid, wherein said slide face of said drive portion of said piston shoe is partially interrupted by, respective to the movement of said slide face on said piston stroke guide face, perpendicularly extending recesses, and, wherein said recesses are subjected to reception of portions of said lubrication fluid of said inner space of said housing.

9. A fluid handling device, comprising, in combination, a high pressure piston 5,5' subjected to reciprocation in a high pressure cylinder 11,11' and driven to a fluid flow delivery stroke at least indirectly by a piston shoe 447,447' which is pivotably located on the foot 448 of a piston, while said piston shoe is driven to a reciprocating and pivoting movement by a piston stroke guide face 505.570 of a piston stroke providing body 444,503 and with a guide portion of said piston shoe permanently during its operation reciprocably and pivotably retained in a cylindrical chamber portion 559, of a chamber forming body 57,502;

wherein said piston shoe 447,447' forms a hollow portion with a first radius 460 around the center 546 of pivotal movement of said piston shoe around said center, wherein said center is located in the axis (axes) through said piston(s), wherein said piston shoe forms a guide portion with an outer face 450, formed by a second radius 461 around said center 546, while said second radius is longer than said first radius, wherein said cylindrical chamber portion forms at least indirectly by its inner face of its wall a cylindrical guide face portion 451,451', wherein said cylindrical guide face portion is formed by a third radius, with said third radius formed around the extending axis of said piston(s), while said third radius is substantially equal to said second radius but exceeds the length of said second radius by at least one thousandth of a millimeter to permit said outer face to slide along said cylindrical guide face at maintaining close guiding of said outer face on said cylindrical guide face, and, whereby said outer face at all times of operation of said device forms by alternating portions of said outer face a line which meets alternating portions of said cylindrical guide face during said reciprocation of said piston(s).

* * * * *